US008525033B2

(12) United States Patent
Grether

(10) Patent No.: US 8,525,033 B2
(45) Date of Patent: Sep. 3, 2013

(54) STRANDED COMPOSITE CABLE AND METHOD OF MAKING AND USING

(75) Inventor: Michael F. Grether, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 482 days.

(21) Appl. No.: 12/192,436

(22) Filed: Aug. 15, 2008

(65) Prior Publication Data

US 2010/0038112 A1 Feb. 18, 2010

(51) Int. Cl.
*H01B 5/08* (2006.01)

(52) U.S. Cl.
USPC ..... 174/128.1

(58) Field of Classification Search
USPC ..... 174/128.1, 128.2
See application file for complete search history.

(56) References Cited

U.S. PATENT DOCUMENTS

| | | | | |
|---|---|---|---|---|
| 1,793,293 | A | 2/1931 | Varney et al. | |
| 3,429,722 | A | 2/1969 | Economy et al. | |
| 3,717,720 | A | 2/1973 | Snellman | |
| 3,795,524 | A | 3/1974 | Sowman | |
| 4,047,965 | A | 9/1977 | Karst et al. | |
| 4,345,112 | A | 8/1982 | Sugata | |
| 4,954,462 | A | 9/1990 | Wood et al. | |
| 5,112,882 | A | 5/1992 | Babu et al. | |
| 5,171,942 | A | 12/1992 | Powers | |
| 5,185,299 | A | 2/1993 | Wood et al. | |
| 5,362,921 | A | 11/1994 | Birkelund et al. | |
| 5,554,826 | A | 9/1996 | Gentry | |
| 5,780,154 | A | 7/1998 | Okano et al. | |
| 6,140,589 | A * | 10/2000 | Blackmore | 174/128.1 |
| 6,180,232 | B1 | 1/2001 | McCullough et al. | |
| 6,245,425 | B1 | 6/2001 | McCullough et al. | |
| 6,247,359 | B1 | 6/2001 | De Angelis | |
| 6,329,056 | B1 | 12/2001 | Deve et al. | |
| 6,336,495 | B1 | 1/2002 | McCullough et al. | |
| 6,344,270 | B1 | 2/2002 | McCullough et al. | |
| 6,447,927 | B1 | 9/2002 | McCullough et al. | |
| 6,460,597 | B1 | 10/2002 | McCullough et al. | |
| 6,485,796 | B1 | 11/2002 | Carpenter | |
| 6,544,645 | B1 | 4/2003 | McCullough et al. | |

(Continued)

FOREIGN PATENT DOCUMENTS

| | | |
|---|---|---|
| GB | 750703 | 6/1956 |
| WO | WO 97/00976 | 1/1997 |

(Continued)

*Primary Examiner* — Chau Nguyen
(74) *Attorney, Agent, or Firm* — James A. Baker; Adam Bramwell

(57) ABSTRACT

Stranded composite cables include a single wire defining a center longitudinal axis, a first multiplicity of composite wires helically stranded around the single wire in a first lay direction at a first lay angle defined relative to the center longitudinal axis and having a first lay length, and a second multiplicity of composite wires helically stranded around the first multiplicity of composite wires in the first lay direction at a second lay angle defined relative to the center longitudinal axis and having a second lay length, the relative difference between the first lay angle and the second lay angle being no greater than about 4°. The stranded composite cables may be used as intermediate articles that are later incorporated into final articles, such as overhead electrical power transmission cables including a multiplicity of ductile wires stranded around the composite wires. Methods of making and using the stranded composite cables are also described.

40 Claims, 9 Drawing Sheets

(56) References Cited

U.S. PATENT DOCUMENTS

| | | | | |
|---|---|---|---|---|
| 6,559,385 | B1 | 5/2003 | Johnson et al. | |
| 6,692,842 | B2 | 2/2004 | McCullough et al. | |
| 6,723,451 | B1 | 4/2004 | McCullough et al. | |
| 6,747,213 | B2 | 6/2004 | Bonicel | |
| 6,796,365 | B1 | 9/2004 | McCullough et al. | |
| 7,093,416 | B2 | 8/2006 | Johnson et al. | |
| 7,131,308 | B2 | 11/2006 | McCullough | |
| 7,409,816 | B2 * | 8/2008 | Susai et al. | 57/231 |
| 2002/0027012 | A1 | 3/2002 | Bonicel | |
| 2003/0194916 | A1 | 10/2003 | Quesnel et al. | |
| 2004/0185290 | A1 | 9/2004 | McCullough et al. | |
| 2005/0279074 | A1 * | 12/2005 | Johnson et al. | 57/212 |
| 2006/0102377 | A1 | 5/2006 | Johnson et al. | |
| 2006/0137880 | A1 | 6/2006 | Figenschou et al. | |
| 2006/0141252 | A1 | 6/2006 | Chartier et al. | |
| 2006/0193572 | A1 | 8/2006 | Mjelstad | |
| 2007/0044992 | A1 | 3/2007 | Bremnes | |
| 2007/0205009 | A1 | 9/2007 | Figenschou | |
| 2007/0237469 | A1 | 10/2007 | Espen | |
| 2007/0253778 | A1 | 11/2007 | Figenschou | |
| 2007/0271897 | A1 | 11/2007 | Hanna | |
| 2008/0081721 | A1 | 4/2008 | Bissig et al. | |
| 2010/0038112 | A1 | 2/2010 | Grether | |

FOREIGN PATENT DOCUMENTS

| | | |
|---|---|---|
| WO | WO 2011/008568 | 1/2011 |
| WO | WO 2011/008620 | 1/2011 |
| WO | WO 2011/094146 | 8/2011 |
| WO | WO 2011/103036 | 8/2011 |

* cited by examiner

STRANDED COMPOSITE CABLE AND METHOD OF MAKING AND USING

TECHNICAL FIELD

The present disclosure relates generally to stranded cables and their method of manufacture and use. The disclosure further relates to stranded cables including helically stranded composite wires and their method of manufacture and use. Such helically stranded composite cables are useful in electrical power transmission cables and other applications.

BACKGROUND

Cable stranding is a process in which individual wires are combined, typically in a helical arrangement, to produce a finished cable. See, e.g., U.S. Pat. Nos. 5,171,942 and 5,554,826. The resulting stranded cable or wire rope provides far greater flexibility than would be available from a solid rod of equivalent cross sectional area. The stranded arrangement is also beneficial because a helically stranded cable maintains its overall round cross-sectional shape when the cable is subject to bending in handling, installation and use. Such helically stranded cables are used in a variety of applications such as hoist cables, aircraft cables, and power transmission cables.

Helically stranded cables are typically produced from ductile metals such as steel, aluminum, or copper. In some cases, such as bare overhead electrical power transmission cables, a helically stranded wire core is surrounded by a wire conductor layer. The helically stranded wire core could comprise ductile metal wires made from a first material such as steel, for example, and the outer power conducting layer could comprise ductile metal wires made from another material such as aluminum, for example. In some cases, the helically stranded wire core may be a pre-stranded cable used as an input material to the manufacture of a larger diameter electrical power transmission cable. Helically stranded cables generally may comprise as few as seven individual wires to more common constructions containing 50 or more wires.

FIG. 1A illustrates an exemplary helically stranded electrical power transmission cable as described in U.S. Pat. No. 5,554,826. The illustrated helically stranded electrical power transmission cable 20 includes a center ductile metal conductor wire 1, a first layer 13 of ductile metal conductor wires 3 (six wires are shown) stranded around the center ductile metal conductor wire 1 in a first lay direction (clockwise is shown, corresponding to a right hand lay direction), a second layer 15 of ductile metal conductor wires 5 stranded around the first layer 13 in a second lay direction opposite to the first lay direction (counter-clockwise is shown, corresponding to a left hand lay direction), and a third layer 17 of ductile metal conductor wires 7 stranded around the second layer 15 in a third lay direction opposite to the second lay direction (clockwise is shown, corresponding to a right hand lay direction).

During the cable stranding process, ductile metal wires are subjected to stresses beyond the yield stress of the metal material but below the ultimate or failure stress. This stress acts to plastically deform the metal wire as it is helically wound about the relatively small radius of the preceding wire layer or center wire. There have been recently introduced useful cable articles from materials that are composite and thus cannot readily be plastically deformed to a new shape. Common examples of these materials include fiber reinforced composites which are attractive due to their improved mechanical properties relative to metals but are primarily elastic in their stress strain response. Composite cables containing fiber reinforced polymer wires are known in the art, as are composite cables containing ceramic fiber reinforced metal wires, see, e.g., U.S. Pat. Nos. 6,559,385 and 7,093,416; and Published PCT Application WO 97/00976.

One use of stranded composite cables (e.g., cables containing polymer matrix composite or metal matrix composite wires) is as a reinforcing member in bare electrical power transmission cables. Although electrical power transmission cables including aluminum matrix composite wires are known, for some applications there is a continuing desire to obtain improved properties. The art continually searches for improved stranded composite cables, and for improved methods of making and using stranded composite cables.

SUMMARY

In some applications, it is desirable to further improve the construction of stranded composite cables and their method of manufacture. In certain applications, it is desirable to improve the physical properties of helically stranded composite cables, for example, their tensile strength and elongation to failure of the cable. In some particular applications, it is further desirable to provide a convenient means to maintain the helical arrangement of the stranded composite wires prior to incorporating them into a subsequent article such as an electrical power transmission cable. Such a means for maintaining the helical arrangement has not been necessary in prior cores with plastically deformable ductile metal wires, or with wires that can be cured or set after being arranged helically.

Certain embodiments of the present invention are directed at stranded composite cables and methods of helically stranding composite wire layers in a common lay direction that result in a surprising increase in tensile strength of the composite cable when compared to composite cables helically stranded using alternate lay directions between each composite wire layer. Such a surprising increase in tensile strength has not been observed for conventional ductile (e.g. metal, or other non-composite) wires when stranded using a common lay direction. Furthermore, there is typically a low motivation to use a common lay direction for the stranded wire layers of a conventional ductile wire cable, because the ductile wires may be readily plastically deformed, and such cables generally use shorter lay lengths, for which alternating lay directions may be preferred for maintaining cable integrity.

Thus, in one aspect, the present disclosure provides an improved stranded composite cable. In exemplary embodiments, the stranded composite cable comprises a single wire defining a center longitudinal axis, a first plurality of composite wires stranded around the single composite wire in a first lay direction at a first lay angle defined relative to the center longitudinal axis and having a first lay length, and a second plurality of composite wires stranded around the first plurality of composite wires in the first lay direction at a second lay angle defined relative to the center longitudinal axis and having a second lay length, the relative difference between the first lay angle and the second lay angle being no greater than about 4°.

In one exemplary embodiment, the stranded cable further comprises a third plurality of composite wires stranded around the second plurality of composite wires in the first lay direction at a third lay angle defined relative to the center longitudinal axis and having a third lay length, the relative difference between the second lay angle and the third lay angle being no greater than about 4°. In another exemplary embodiment, the stranded cable further comprises a fourth plurality of composite wires stranded around the third plurality of composite wires in the first lay direction at a fourth lay angle defined relative to the center longitudinal axis and having a fourth lay length, the relative difference between the third lay angle and the fourth lay angle being no greater than about 4°.

In further exemplary embodiments, the stranded cable may further comprise additional composite wires stranded around the fourth plurality of composite wires in the first lay direction at a lay angle defined relative to the common longitudinal axis, wherein the composite wires have a characteristic lay length, and the relative difference between the fourth lay angle and any subsequent lay angle is no greater than about 4°.

In certain exemplary embodiments, the relative difference between the first lay angle and the second lay angle, the second lay angle and the third lay angle, the third lay angle and the fourth lay angle, and in general, any inner layer lay angle and the adjacent outer layer lay angle, is no greater than 4°, more preferably no greater than 3°, most preferably no greater than 0.5°. In some embodiments, the first lay angle equals the second lay angle, the second lay angle equals the third lay angle, the third lay angle equals the fourth lay angle, and in general, any inner layer lay angle equals the adjacent outer layer lay angle.

In further embodiments, one or more of the first lay length is less than or equal to the second lay length, the second lay length is less than or equal to the third lay length, the fourth lay length is less than or equal to an immediately subsequent lay length, and/or each succeeding lay length is less than or equal to the immediately preceding lay length. In other embodiments, one or more of the first lay length equals the second lay length, the second lay length equals the third lay length, and the third lay length equals the fourth lay length. In some embodiments, it may be preferred to use a parallel lay, as is known in the art.

In a further aspect, the present disclosure provides alternative embodiments of a stranded electrical power transmission cable comprising a core and a conductor layer around the core, in which the core comprises any of the above-described stranded composite cables. In some exemplary embodiments, the stranded cable further comprises a plurality of ductile wires stranded around the stranded composite wires of the stranded composite cable core.

In certain exemplary embodiments, the plurality of ductile wires is stranded about the center longitudinal axis in a plurality of radial layers surrounding the composite wires of the composite cable core. In additional exemplary embodiments, at least a portion of the plurality of ductile wires is stranded in the first lay direction at a lay angle relative to the center longitudinal axis, and at a first lay length of ductile wires. In other exemplary embodiments, at least a portion of the plurality of ductile wires is stranded in a second lay direction at a lay angle defined relative to the center longitudinal axis, and at a second lay length of ductile wires.

In any of the above aspects of stranded cables and their related embodiments, the following exemplary embodiments may be employed advantageously. Thus, in one exemplary embodiment, the single wire has a cross-sectional shape taken in a direction substantially normal to the center longitudinal axis that is circular or elliptical. In certain exemplary embodiments, the single wire is a composite wire. In additional exemplary embodiments, each composite wire and/or ductile wire has a cross-section, in a direction substantially normal to the center longitudinal axis, selected from circular, elliptical, and trapezoidal.

In further exemplary embodiments, the stranded cable further comprises a maintaining means around at least one of the first plurality of composite wires, the second plurality of composite wires, the third plurality of composite wires, or the fourth plurality of composite wires. In some exemplary embodiments, the maintaining means comprises at least one of a binder or a tape. In certain exemplary embodiments, the tape comprises an adhesive tape wrapped around at least one of the first plurality of composite wires or the second plurality of composite wires. In certain presently preferred embodiments, the adhesive tape comprises a pressure sensitive adhesive.

In an additional aspect, the disclosure provides a method of making the stranded cable as described in the above aspects and embodiments, comprising stranding a first plurality of composite wires about a single wire defining a center longitudinal axis, wherein stranding the first plurality of composite wires is carried out in a first lay direction at a first lay angle defined relative to the center longitudinal axis, wherein the first plurality of wires have a first lay length; and stranding a second plurality of composite wires around the first plurality of composite wires, wherein stranding the second plurality of composite wires is carried out in the first lay direction at a second lay angle defined relative to the center longitudinal axis, and wherein the second plurality of wires has a second lay length, further wherein a relative difference between the first lay angle and the second lay angle is no greater than 4°. In one particular embodiment, the method further comprises stranding a plurality of ductile wires around the composite wires.

Exemplary embodiments of stranded composite cables according to the present disclosure have various features and characteristics that enable their use and provide advantages in a variety of applications. For example, in some exemplary embodiments, stranded composite cables according to the present disclosure may exhibit a reduced tendency to undergo premature fracture or failure at lower values of cable tensile strain during manufacture or use, when compared to other composite cables. In addition, stranded composite cables according to some exemplary embodiments may exhibit improved corrosion resistance, environmental endurance (e.g., UV and moisture resistance), resistance to loss of strength at elevated temperatures, creep resistance, as well as relatively high elastic modulus, low density, low coefficient of thermal expansion, high electrical conductivity, high sag resistance, and high strength, when compared to conventional stranded ductile metal wire cables.

In some exemplary embodiments, stranded composite cables made according to embodiments of the present disclosure may exhibit an increase in tensile strength of 10% or greater compared to prior art composite cables. Stranded composite cables according to certain embodiments of the present disclosure may also be made at a lower manufacturing cost due to an increase in yield from the stranding process of cable meeting the minimum tensile strength requirements for use in certain critical applications, for example, use in overhead electrical power transmission applications.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF DRAWINGS

Exemplary embodiments of the present disclosure are further described with reference to the appended figures, wherein.

Like reference numerals in the drawings indicate like elements. The drawings herein as not to scale, and in the drawings, the components of the composite cables are sized to emphasize selected features.

DETAILED DESCRIPTION

Figure 1A:
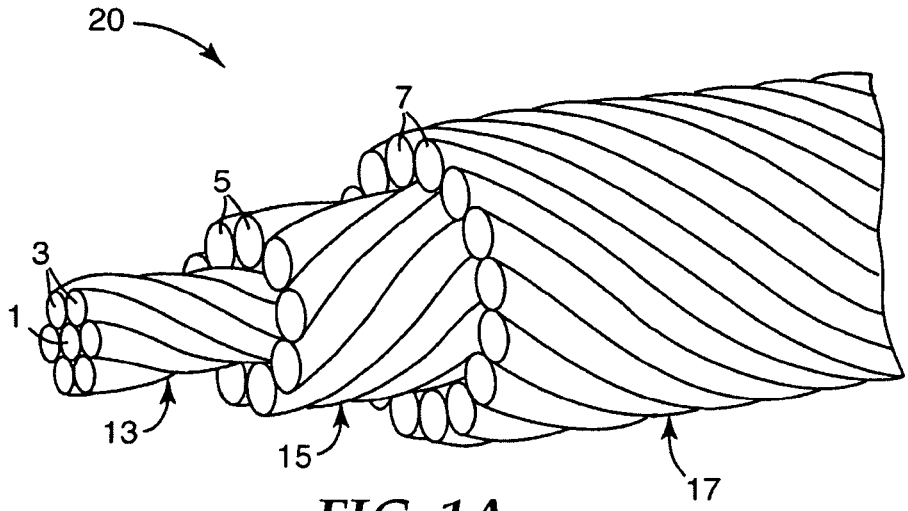
FIG. 1A Prior Art
FIG. 1A is a perspective view of a prior art helically stranded electrical power transmission cable.

Certain terms are used throughout the description and the claims that, while for the most part are well known, may require some explanation. It should understood that, as used herein, when referring to a "wire" as being "brittle," this means that the wire will fracture under tensile loading with minimal plastic deformation.

The term "ductile" when used to refer to the deformation of a wire, means that the wire would substantially undergo plastic deformation during bending without fracture or breakage.

The term "composite wire" refers to a wire formed from a combination of materials differing in composition or form which are bound together, and which exhibit brittle or non-ductile behavior.

The term "metal matrix composite wire" refers to a composite wire comprising one or more reinforcing materials bound into a matrix consisting of one or more ductile metal phases.

The term "polymer matrix composite wire" similarly refers to a composite wire comprising one or more reinforcing materials bound into a matrix consisting of one or more polymeric phases.

The term "bend" or "bending" when used to refer to the deformation of a wire includes two dimensional and/or three dimensional bend deformation, such as bending the wire helically during stranding. When referring to a wire as having bend deformation, this does not exclude the possibility that the wire also has deformation resulting from tensile and/or torsional forces.

"Significant elastic bend" deformation means bend deformation which occurs when the wire is bent to a radius of curvature up to 10,000 times the radius of the wire. As applied to a circular cross section wire, this significant elastic bend deformation would impart a strain at the outer fiber of the wire of at least 0.01%.

The terms "cabling" and "stranding" are used interchangeably, as are "cabled" and "stranded."

The term "lay" describes the manner in which the wires in a stranded layer of a helically stranded cable are wound into a helix.

The term "lay direction" refers to the stranding direction of the wire strands in a helically stranded layer. To determine the lay direction of a helically stranded layer, a viewer looks at the surface of the helically stranded wire layer as the cable points away from the viewer. If the wire strands appear to turn in a clockwise direction as the strands progress away from the viewer, then the cable is referred to as having a "right hand lay." If the wire strands appear to turn in a counter-clockwise direction as the strands progress away from the viewer, then the cable is referred to as having a "left hand lay."

The terms "center axis" and "center longitudinal axis" are used interchangeably to denote a common longitudinal axis positioned radially at the center of a multilayer helically stranded cable.

The term "lay angle" refers to the angle, formed by a stranded wire, relative to the center longitudinal axis of a helically stranded cable.

The term "crossing angle" means the relative (absolute) difference between the lay angles of adjacent wire layers of a helically stranded wire cable.

The term "lay length" refers to the length of the stranded cable in which a single wire in a helically stranded layer completes one full helical revolution about the center longitudinal axis of a helically stranded cable.

The term "ceramic" means glass, crystalline ceramic, glass-ceramic, and combinations thereof.

The term "polycrystalline" means a material having predominantly a plurality of crystalline grains in which the grain size is less than the diameter of the fiber in which the grains are present.

The term "continuous fiber" means a fiber having a length that is relatively infinite when compared to the average fiber diameter. Typically, this means that the fiber has an aspect ratio (i.e., ratio of the length of the fiber to the average diameter of the fiber) of at least $1\times10^5$ (in some embodiments, at least $1\times10^6$, or even at least $1\times10^7$). Typically, such fibers have a length on the order of at least about 15 cm to at least several meters, and may even have lengths on the order of kilometers or more.

The present disclosure provides a stranded cable that includes a plurality of stranded composite wires. The composite wires may be brittle and non-ductile, and thus may not be sufficiently deformed during conventional cable stranding processes in such a way as to maintain their helical arrangement without breaking the wires. Therefore, the present disclosure provides, in certain embodiments, a higher tensile strength stranded composite cable, and further, provides, in some embodiments, a means for maintaining the helical arrangement of the wires in the stranded cable. In this way, the stranded cable may be conveniently provided as an intermediate article or as a final article. When used as an intermediate article, the stranded composite cable may be later incorporated into a final article such as an electrical power transmission cable, for example, an overhead electrical power transmission cable.

Figure 1B:
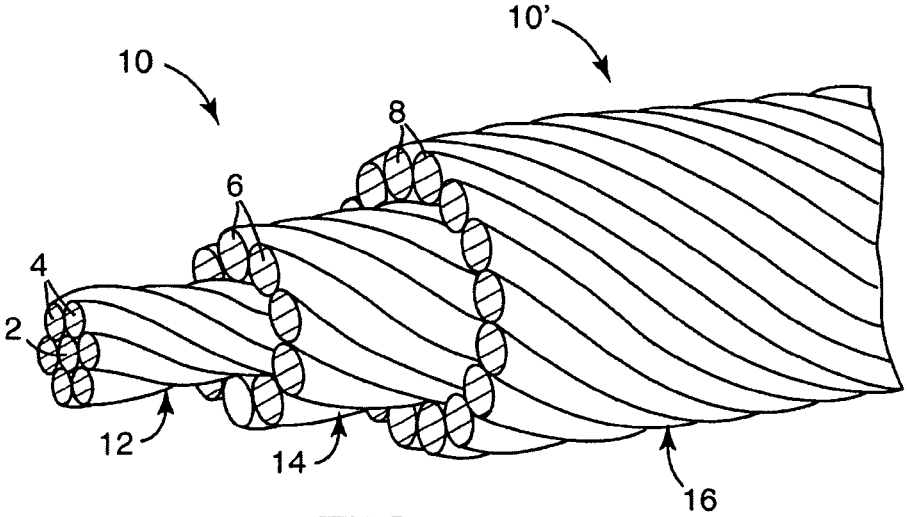
FIG. 1B is a perspective view of a helically stranded composite cable according to exemplary embodiments of the present disclosure.

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof Thus in one aspect, the present disclosure provides a stranded composite cable. Referring to the drawings, FIG. 1B illustrates a perspective view of a stranded composite cable 10 according to an exemplary embodiment of the present disclosure. As illustrated, the helically stranded composite cable 10 includes a single wire 2 defining a center longitudinal axis, a first layer 12 comprising a first plurality of composite wires 4 stranded around the single composite wire 2 in a first lay direction (clockwise is shown, corresponding to a right hand lay), and a second layer 14 comprising a second plurality of composite wires 6 stranded around the first plurality of composite wires 4 in the first lay direction.

Optionally, a third layer 16 comprising a third plurality of composite wires 8 may be stranded around the second plurality of composite wires 6 in the first lay direction to form composite cable 10'. Optionally, a fourth layer (not shown) or even more additional layers of composite wires may be stranded around the second plurality of composite wires 6 in the first lay direction to form composite cable 10'. Optionally, the single wire 2 is a composite wire as shown in FIG. 1B, although in other embodiments, the single wire 2 may be a ductile wire, for example, a ductile metal wire 1 as shown in FIG. 1A.

In exemplary embodiments of the disclosure, two or more stranded layers (e.g. 12, 14 and 16) of composite wires (e.g. 4, 6 and 8) may be helically wound about a single center wire 2 defining a center longitudinal axis, provided that each successive layer of composites wires is wound in the same lay direction as each preceding layer of composite wires. Furthermore, it will be understood that while a right hand lay is illustrated in FIG. 1B for each layer (12, 14 and 16), a left hand lay may alternatively be used for each layer (12, 14 and 16).

Figure 2A:
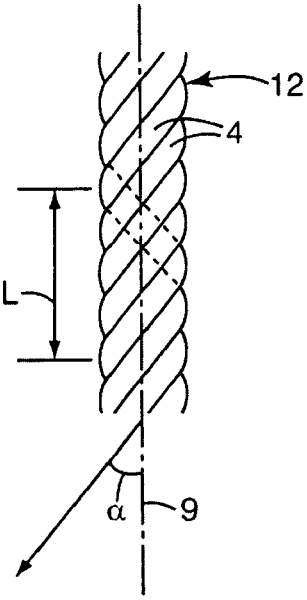
FIGS. 2A-2C are schematic, top views of composite cables layers laid according to exemplary embodiments of the present disclosure, illustrating the lay direction, lay angle and lay length for each cable layer.
Figure 2B:
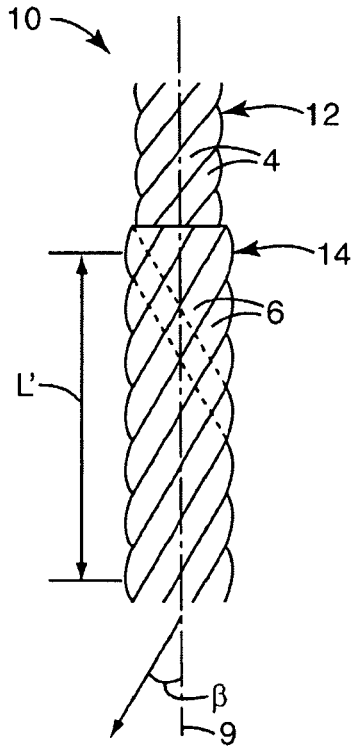
Figure 2C:
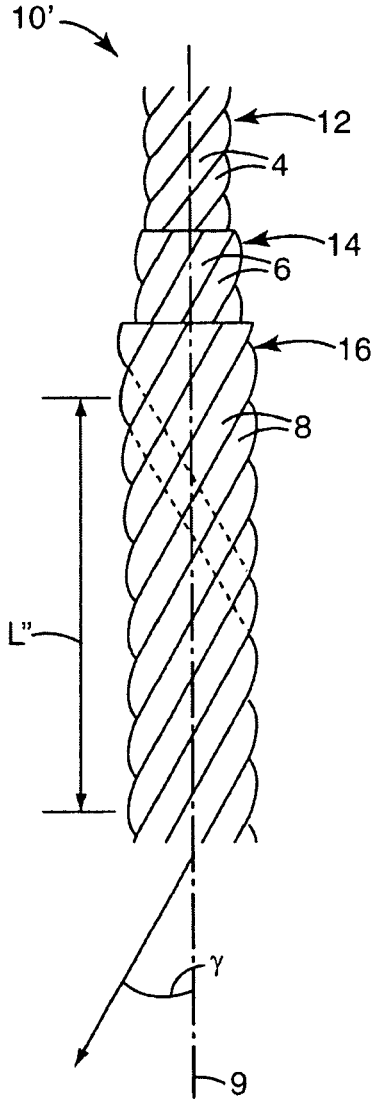

With reference to FIGS. 1B and FIGS. 2A-2C, in further exemplary embodiments, the stranded composite cable comprises a single wire 2 defining a center longitudinal axis 9, a first plurality of composite wires 4 stranded around the single composite wire 2 in a first lay direction at a first lay angle $\alpha$ defined relative to the center longitudinal axis 9 and having a first lay length L (FIG. 2A), and a second plurality of composite wires 6 stranded around the first plurality of composite wires 4 in the first lay direction at a second lay angle $\beta$ defined relative to the center longitudinal axis 9 and having a second lay length L' (FIG. 2B).

In additional exemplary embodiments, the stranded cable further optionally comprises a third plurality of composite wires 8 stranded around the second plurality of composite wires 6 in the first lay direction at a third lay angle $\gamma$ defined relative to the center longitudinal axis 9 and having a third lay length L" (FIG. 2C), the relative difference between the second lay angle $\beta$ and the third lay angle $\gamma$ being no greater than about 4°.

In further exemplary embodiments (not shown), the stranded cable may further comprise additional (e.g. subsequent) layers (e.g. a fourth, fifth, or other subsequent layer) of composite wires stranded around the third plurality of composite wires 8 in the first lay direction at a lay angle (not shown in the figures) defined relative to the common longitudinal 9 axis, wherein the composite wires in each layer have a characteristic lay length (not shown in the figures), the relative difference between the third lay angle $\gamma$ and the fourth or subsequent lay angle being no greater than about 4°. Embodiments in which four or more layers of stranded composite wires are employed preferably make use of composite wires having a diameter of 0.5 mm or less.

In some exemplary embodiments, the relative (absolute) difference between the first lay angle $\alpha$ and the second lay angle $\beta$ is no greater than about 4°. In certain exemplary embodiments, the relative (absolute) difference between one or more of the first lay angle $\alpha$ and the second lay angle $\beta$, the second lay angle $\beta$ and the third lay angle $\gamma$, is no greater than 4°, no greater than 3°, no greater than 2°, no greater than 1°, or no greater than 0.5°. In certain exemplary embodiments, one or more of the first lay angle equals the second lay angle, the second lay angle equals the third lay angle, and/or each succeeding lay angle equals the immediately preceding lay angle.

In further embodiments, one or more of the first lay length is less than or equal to the second lay length, the second lay length is less than or equal to the third lay length, the fourth lay length is less than or equal to an immediately subsequent lay length, and/or each succeeding lay length is less than or equal to the immediately preceding lay length. In other embodiments, one or more of the first lay length equals the second lay length, the second lay length equals the third lay length, and/or each succeeding lay length equals the immediately preceding lay length. In some embodiments, it may be preferred to use a parallel lay, as is known in the art.

Various stranded composite cable embodiments (10, 11, 10', 11') are illustrated by cross-sectional views in FIGS. 3A, 3B, 3C and 3D, respectively. In each of the illustrated embodiments of FIGS. 3A-3D, it is understood that the composite wires (4, 6, and 8) are stranded about a single wire (2 in FIGS. 3A and 3C; 1 in FIGS. 3B and 3D) defining a center longitudinal axis (not shown), in a lay direction (not shown) which is the same for each corresponding layer (12, 14 and 16 as shown in FIG. 1B) of composite wires (4, 6, and 8). Such lay direction may be clockwise (right hand lay as shown in FIG. 1B) or counter-clockwise (left hand lay, not shown).

Figure 3A:
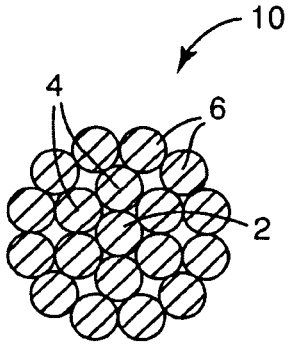
FIGS. 3A-3D are cross-sectional end views of various helically stranded composite cables according to exemplary embodiments of the present disclosure.
Figure 3B:
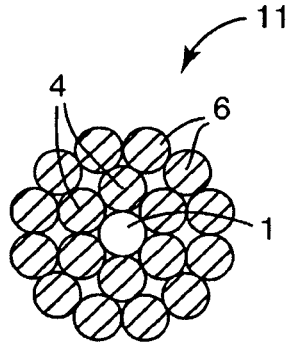
Figure 3C:
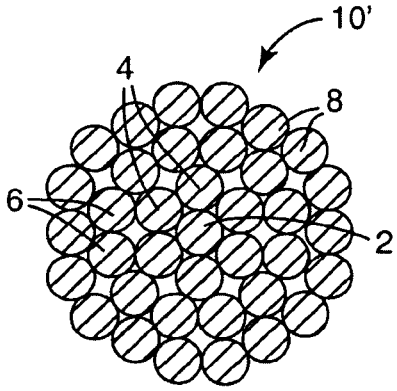
Figure 3D:
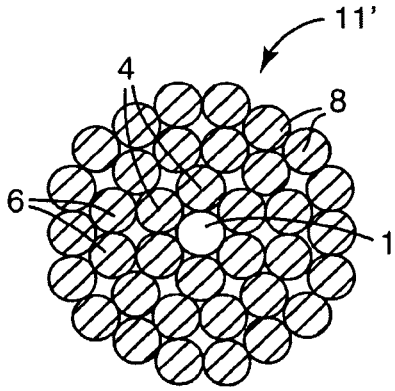

Although FIGS. 3A and 3C show a single center composite wire 2 defining a center longitudinal axis (not shown), it is additionally understood that single wire 2 may be a ductile metal wire 1, as shown in FIGS. 3B and 3D. It is further understood that each layer of composite wires exhibits a lay length (not shown in FIGS. 3A-3D), and that the lay length of each layer of composite wires may be different, or preferably, the same lay length.

Furthermore, it is understood that in some exemplary embodiments, each of the composite wires has a cross-sectional shape, in a direction substantially normal to the center longitudinal axis, generally circular, elliptical, or trapezoidal.

In certain exemplary embodiments, each of the composite wires has a cross-sectional shape that is generally circular, and the diameter of each composite wire is at least about 0.1 mm, more preferably at least 0.5 mm; yet more preferably at least 1 mm, still more preferably at least 2 mm, most preferably at least 3 mm; and at most about 15 mm, more preferably at most 10 mm, still more preferably at most 5 mm, even more preferably at most 4 mm, most preferably at most 3 mm. In other exemplary embodiments, the diameter of each composite wire may be less than 1 mm, or greater than 5 mm.

Typically the average diameter of the single center wire, having a generally circular cross-sectional shape, is in a range from about 0.1 mm to about 15 mm. In some embodiments, the average diameter of the single center wire is desirably is at least about 0.1 mm, at least 0.5 mm, at least 1 mm, at least 2 mm, at least 3 mm, at least 4 mm, or even up to about 5 mm. In other embodiments, the average diameter of the single central wire is less than about 0.5 mm, less than 1 mm, less than 3 mm, less than 5 mm, less than 10 mm, or less than 15 mm.

In additional exemplary embodiments not illustrated by FIGS. 3A-3D, the stranded composite cable may include more than three stranded layers of composite wires about the single wire defining a center longitudinal axis. In certain exemplary embodiments, each of the composite wires in each layer of the composite cable may be of the same construction and shape; however this is not required in order to achieve the benefits described herein.

In a further aspect, the present disclosure provides various embodiments of a stranded electrical power transmission cable comprising a composite core and a conductor layer around the composite core, and in which the composite core comprises any of the above-described stranded composite cables. In some embodiments, the electrical power transmission cable may be useful as an overhead electrical power transmission cable, or an underground electrical power transmission cable. In certain exemplary embodiments, the conductor layer comprises a metal layer which contacts substantially an entire surface of the composite cable core. In other exemplary embodiments, the conductor layer comprises a plurality of ductile metal conductor wires stranded about the composite cable core.

FIGS. 4A-4E illustrate exemplary embodiments of stranded cables (30, 40, 50, 60 or 70, corresponding to FIGS. 4A, 4B, 4C, 4D and 4E) in which one or more additional layers of ductile wires (e.g. 28, 28', 28"), for example, ductile metal conductor wires, are helically stranded around the composite cable core 10 of FIG. 3A. It will be understood, however, that the disclosure is not limited to these exemplary embodiments, and that other embodiments, using other composite cable cores (for example, composite cables 11, 10', and 11' of FIGS. 3B, 3C and 3D, respectively), are within the scope of this disclosure.

Figure 4A:
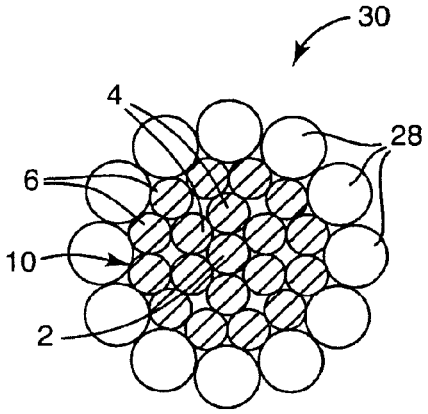
FIGS. 4A-4E are cross-sectional end views of various helically stranded composite cables including one or more layers comprising a plurality of ductile wires stranded around the helically stranded composite wires according to other exemplary embodiments of the present disclosure.

Thus, in the particular embodiment illustrated by FIG. 4A, the stranded cable 30 comprises a first plurality of ductile wires 28 stranded around the stranded composite cable 10 shown in FIGS. 1B, 2A-2B, and 3A. In an additional embodiment illustrated by FIG. 4B, the stranded cable 40 comprises a second plurality of ductile wires 28' stranded around the first plurality of ductile wires 28 of stranded cable 30 of FIG. 4A. In a further embodiment illustrated by FIG. 4C, the stranded cable 50 comprises a third plurality of ductile wires 28" stranded around the second plurality of ductile wires 28' of stranded cable 40 of FIG. 4B.

Figure 4B:
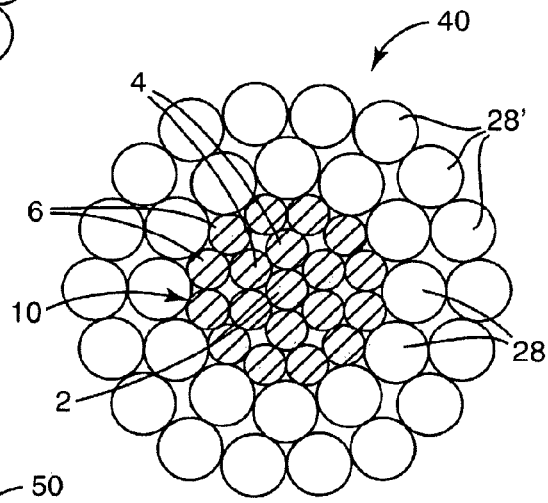
Figure 4C:
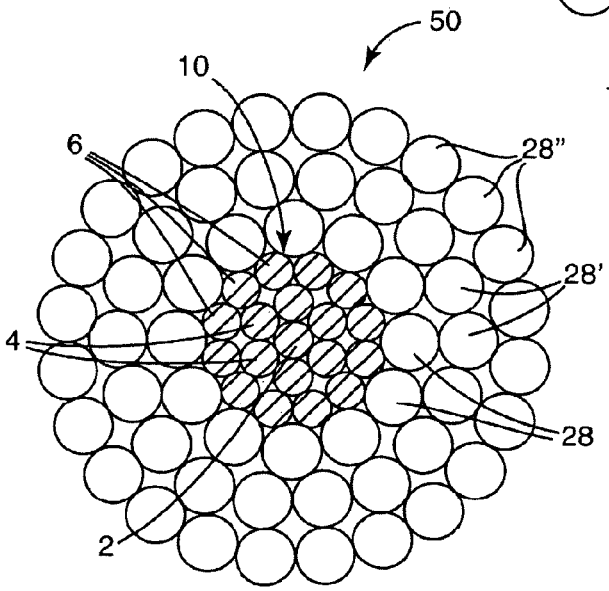
Figure 4D:
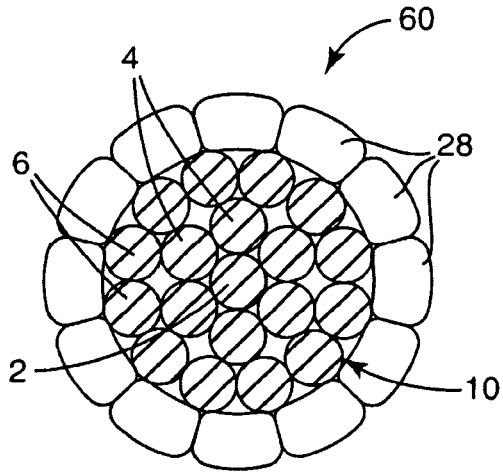
Figure 4E:
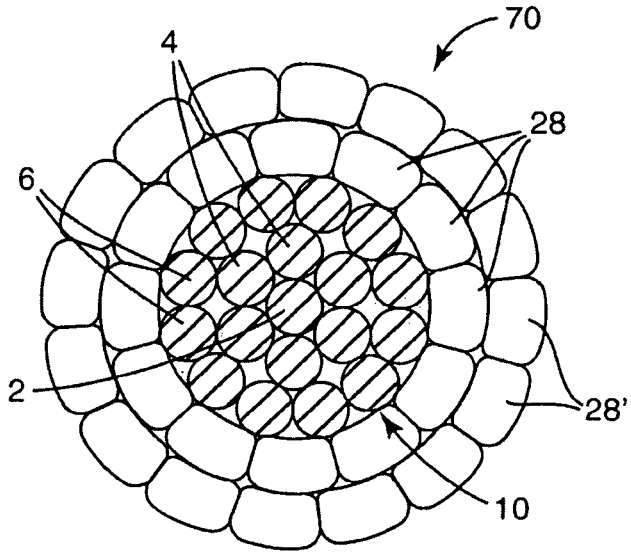

In the particular embodiments illustrated by FIGS. 4A-4C, the respective stranded cables (30, 40 or 50) have a core comprising the stranded composite cable 10 of FIG. 3A, which includes a single wire 2 defining the center longitudinal axis 9 (FIG. 2C), a first layer 12 comprising a first plurality of composite wires 4 stranded around the single composite wire 2 in a first lay direction, a second layer 14 comprising a second plurality of composite wires 6 stranded around the first plurality of composite wires 4 in the first lay direction. In certain exemplary embodiments, the first plurality of ductile wires 28 is stranded in a lay direction opposite to that of an adjoining radial layer, for example, second layer 14 comprising the second plurality of composite wires 6.

In other exemplary embodiments, the first plurality of ductile wires 28 is stranded in a lay direction the same as that of an adjoining radial layer, for example, second layer 14 comprising the second plurality of composite wires 6. In further exemplary embodiments, at least one of the first plurality of ductile wires 28, the second plurality of ductile wires 28', or the third plurality of ductile wires 28", is stranded in a lay direction opposite to that of an adjoining radial layer, for example, second layer 14 comprising the second plurality of composite wires 6.

In further exemplary embodiments, each ductile wire (28, 28', or 28") has a cross-sectional shape, in a direction substantially normal to the center longitudinal axis, selected from circular, elliptical, or trapezoidal. FIGS. 4A-4C illustrate embodiments wherein each ductile wire (28, 28', or 28") has a cross-sectional shape, in a direction substantially normal to the center longitudinal axis, that is substantially circular. In the particular embodiment illustrated by FIG. 4D, the stranded cable 60 comprises a first plurality of generally trapezoidal-shaped ductile wires 28 stranded around the stranded composite cable 10 shown in FIGS. 1B, 2A-2B. In a further embodiment illustrated by FIG. 4E, the stranded cable 70 further comprises a second plurality of generally trapezoidal-shaped ductile wires 28' stranded around the stranded cable 60 of FIG. 4D.

In further exemplary embodiments, some or all of the ductile wires (28, 28', or 28") may have a cross-sectional shape, in a direction substantially normal to the center longitudinal axis, that is "Z" or "S" shaped (not shown). Wires of such shapes are known in the art, and may be desirable, for example, to form an interlocking outer layer of the cable.

In additional embodiments, the ductile wires (28, 28', or 28") comprise at least one metal selected from the group consisting of copper, aluminum, iron, zinc, cobalt, nickel, chromium, titanium, tungsten, vanadium, zirconium, manganese, silicon, alloys thereof, and combinations thereof.

The stranded composite cables may be used as intermediate articles that are later incorporated into final articles, for example, towing cables, hoist cables, overhead electrical power transmission cables, and the like, by stranding a multiplicity of ductile wires around a core comprising composite wires, for example, the helically stranded composite cables previously described, or other stranded composite cables. For example, the core can be made by stranding (e.g., helically winding) two or more layers of composite wires (4, 6, 8) around a single center wire (2) as described above using techniques known in the art. Typically, such helically stranded composite cable cores tend to comprise as few as 19 individual wires to 50 or more wires.

Figure 5A:
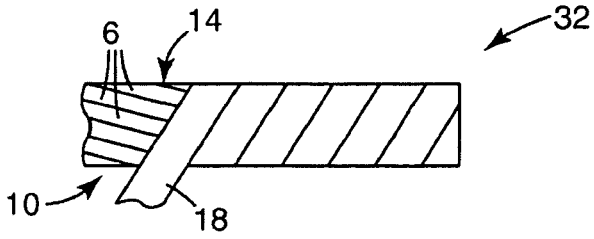
FIG. 5A is a side view of a helically stranded composite cable including maintaining means around the stranded composite wire core according to further exemplary embodiment of the present disclosure.
Figure 5B:
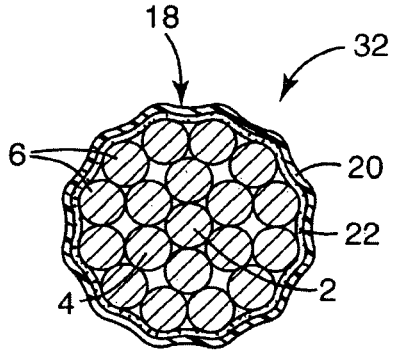
FIGS. 5B-5D are cross-sectional end views of a helically stranded composite cables including various maintaining means around the stranded composite wire core according to other exemplary embodiments of the present disclosure.
Figure 5C:
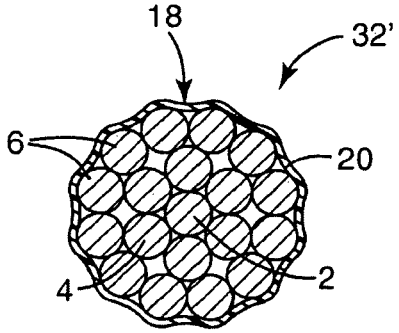

For cores comprised of a plurality of composite wires (2, 4, 6), it is desirable, in some embodiments, to hold the composite wires (e.g. at least the second plurality of composite wires 6 in second layer 14 of FIGS. 5A-5D) together during or after stranding using a maintaining means, for example, a tape overwrap, with or without adhesive, or a binder (see, e.g., U.S. Pat. No. 6,559,385 B1 (Johnson et al.)). FIGS. 5A-5C illustrate various embodiments using a maintaining means in the form of a tape 18 to hold the composite wires together after stranding.

FIG. 5A is a side view of the stranded cable 10 (FIGS. 1B, 2A-2B, and 3A), with an exemplary maintaining means comprising a tape 18 partially applied to the stranded composite cable 10 around the composite wires (2, 4, 6). As shown in FIG. 5B, tape 18 may comprise a backing 20 with an adhesive layer 22. Alternatively, as shown in FIG. 5C, the tape 18 may comprise only a backing 20, without an adhesive.

In certain exemplary embodiments, tape 18 may be wrapped such that each successive wrap abuts the previous wrap without a gap and without overlap, as is illustrated in FIG. 5A. Alternatively, in some embodiments, successive wraps may be spaced so as to leave a gap between each wrap or so as to overlap the previous wrap. In one preferred embodiment, the tape 18 is wrapped such that each wrap overlaps the preceding wrap by approximately ⅓ to ½ of the tape width.

FIG. 5B is an end view of the stranded cable of FIG. 5A in which the maintaining means is a tape 18 comprises a backing 20 with an adhesive 22. In this exemplary embodiment, suitable adhesives include, for example, (meth)acrylate (co)polymer based adhesives, poly($\alpha$-olefin) adhesives, block copolymer based adhesives, natural rubber based adhesives, silicone based adhesives, and hot melt adhesives. Pressure sensitive adhesives may be preferred in certain embodiments.

In further exemplary embodiments, suitable materials for tape 18 or backing 20 include metal foils, particularly aluminum; polyester; polyimide; and glass reinforced backings; provided the tape 18 is strong enough to maintain the elastic bend deformation and is capable of retaining its wrapped configuration by itself, or is sufficiently restrained if necessary. One particularly preferred backing 20 is aluminum. Such a backing preferably has a thickness of between 0.002 and 0.005 inches (0.05 to 0.13 mm), and a width selected based on the diameter of the stranded cable 10. For example, for a stranded cable 10 having two layers of stranded composite wires such as such as illustrated in FIG. 5A, and having a diameter of about 0.5 inches (1.3 cm), an aluminum tape having a width of 1.0 inch (2.5 cm) is preferred.

Some presently preferred commercially available tapes include the following Metal Foil Tapes (available from 3M Company, St. Paul, Minn.): Tape 438, a 0.005 inch thick (0.13 mm) aluminum backing with acrylic adhesive and a total tape thickness of 0.0072 inches (0.18 mm); Tape 431, a 0.0019 inch thick (0.05 mm) aluminum backing with acrylic adhesive and a total tape thickness of 0.0031 inches (0.08 mm); and Tape 433, a 0.002 inch thick (0.05 mm) aluminum backing with silicone adhesive and a total tape thickness of 0.0036 inches (0.09 mm). A suitable metal foil/glass cloth tape is Tape 363 (available from 3M Company, St. Paul, Minn.), as described in the Examples. A suitable polyester backed tape includes Polyester Tape 8402 (available from 3M Company, St. Paul, Minn.), with a 0.001 inch thick (0.03 mm) polyester backing, a silicone based adhesive, and a total tape thickness of 0.0018 inches (0.03 mm).

FIG. 5C is an end view of the stranded cable of FIG. 5A in which tape 18 comprises a backing 20 without adhesive 22. When tape 18 is a backing 20 without adhesive, suitable materials for backing 20 include any of those just described for use with an adhesive, with a preferred backing being an aluminum backing having a thickness of between 0.002 and 0.005 inches (0.05 to 0.13 mm) and a width of 1.0 inch (2.54 cm).

When using tape 18 as the maintaining means, either with or without adhesive 22, the tape may be applied to the stranded cable with conventional tape wrapping apparatus as is known in the art. Suitable taping machines include those available from Watson Machine, International, Patterson, N.J., such as model number CT-300 Concentric Taping Head. The tape overwrap station is generally located at the exit of the cable stranding apparatus and is applied to the helically stranded composite wires prior to the cable 10 being wound onto a take up spool. The tape 18 is selected so as to maintain the stranded arrangement of the elastically deformed composite wires.

Figure 5D:
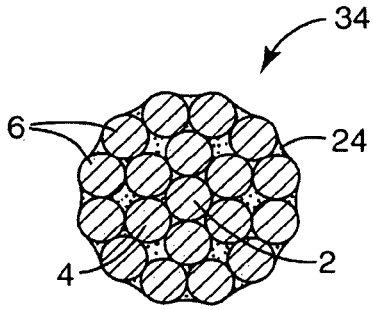

FIG. 5D illustrates alternative exemplary embodiments of a stranded composite cable 34 with a maintaining means in the form of a binder 24 applied to the stranded cable 10 to maintain the composite wires (2, 4, 6) in their stranded arrangement. Suitable binders 24 include pressure sensitive adhesive compositions comprising one or more poly (alpha-olefin) homopolymers, copolymers, terpolymers, and tetrapolymers derived from monomers containing 6 to 20 carbon atoms and photoactive crosslinking agents as described in U.S. Pat. No. 5,112,882 (Babu et al.), which is incorporated herein by reference. Radiation curing of these materials provides adhesive films having an advantageous balance of peel and shear adhesive properties.

Alternatively, the binder 24 may comprise thermoset materials, including but not limited to epoxies. For some binders, it is preferable to extrude or otherwise coat the binder 24 onto the stranded cable 10 while the wires are exiting the cabling machine as discussed above. Alternatively, the binder 24 can be applied in the form of an adhesive supplied as a transfer tape. In this case, the binder 24 is applied to a transfer or release sheet (not shown). The release sheet is wrapped around the composite wires of the stranded cable 10. The backing is then removed, leaving the adhesive layer behind as the binder 24.

In further embodiments, an adhesive 22 or binder 24 may optionally be applied around each individual layer of composite wires (e.g. 12, 14, 16 in FIG. 1B) or between any suitable layer of composite wires (e.g. 2, 4, 6, 8 in FIG. 1B) as is desired.

In one presently preferred embodiment, the maintaining means does not significantly add to the total diameter of the stranded composite cable 10. Preferably, the outer diameter of the stranded composite cable including the maintaining means is no more than 110% of the outer diameter of the plurality of stranded composite wires (2, 4, 6, 8) excluding the maintaining means, more preferably no more than 105%, and most preferably no more than 102%.

It will be recognized that the composite wires have a significant amount of elastic bend deformation when they are stranded on conventional cabling equipment. This significant elastic bend deformation would cause the wires to return to their un-stranded or unbent shape if there were not a maintaining means for maintaining the helical arrangement of the wires. Therefore, in some embodiments, the maintaining means is selected so as to maintain significant elastic bend deformation of the plurality of stranded composite wires (e.g. 2, 4, 6, 8 in FIG. 1B).

Furthermore, the intended application for the stranded cable 10 may suggest certain maintaining means are better suited for the application. For example, when the stranded cable 10 is used as a core in a power transmission cable, either the binder 24 or the tape 18 without an adhesive 22 should be selected so as to not adversely affect the transmission cable at the temperatures and other conditions experienced in this application. When an adhesive tape 18 is used as the maintaining means, both the adhesive 22 and the backing 20 should be selected to be suitable for the intended application.

In certain exemplary embodiments, the stranded composite wires (e.g. 2, 4, 6, 8 in FIG. 1B) each comprise a plurality of continuous fibers in a matrix as will be discussed in more detail later. Because the wires are composite, they do not take on a plastic deformation during the cabling operation which would be possible with ductile wires. For example, in prior art arrangements including ductile wires, the conventional cabling process could be carried out so as to permanently plastically deform the composite wires in their helical arrangement. The present disclosure allows use of composite wires which can provide superior desired characteristics compared to conventional non-composite wires. The maintaining means allows the stranded composite cable to be conveniently handled as a final article or to be conveniently handled before being incorporated into a subsequent final article.

While the present disclosure may be practiced with any suitable composite wire, in certain exemplary embodiments, each of the composite wires is selected to be a fiber reinforced composite wire comprising at least one of a continuous fiber tow or a continuous monofilament fiber in a matrix.

A preferred embodiment for the composite wires comprises a plurality of continuous fibers in a matrix. A preferred fiber comprises polycrystalline $\alpha$-$Al_2O_3$. These preferred embodiments for the composite wires preferably have a tensile strain to failure of at least 0.4%, more preferably at least 0.7%. In some embodiments, at least 85% (in some embodiments, at least 90%, or even at least 95%) by number of the fibers in the metal matrix composite core are continuous.

Other composite wires that could be used with the present disclosure include glass/epoxy wires; silicon carbide/aluminum composite wires; carbon/aluminum composite wires; carbon/epoxy composite wires; carbon/polyetheretherketone (PEEK) wires; carbon/(co)polymer wires; and combinations of such composite wires.

Examples of suitable glass fibers include A-Glass, B-Glass, C-Glass, D-Glass, S-Glass, AR-Glass, R-Glass, fiberglass and paraglass, as known in the art. Other glass fibers may also be used; this list is not limited, and there are many different types of glass fibers commercially available, for example, from Corning Glass Company (Corning, N.Y.).

In some exemplary embodiments, continuous glass fibers may be preferred. Typically, the continuous glass fibers have an average fiber diameter in a range from about 3 micrometers to about 19 micrometers. In some embodiments, the glass fibers have an average tensile strength of at least 3 GPa, 4 GPa, and or even at least 5 GPa. In some embodiments, the glass fibers have a modulus in a range from about 60 GPa to 95 GPa, or about 60 GPa to about 90 GPa.

Examples of suitable ceramic fibers include metal oxide (e.g., alumina) fibers, boron nitride fibers, silicon carbide fibers, and combination of any of these fibers. Typically, the ceramic oxide fibers are crystalline ceramics and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous ceramic fibers have an average fiber diameter in a range from about 5 micrometers to about 50 micrometers, about 5 micrometers to about 25 micrometers about 8 micrometers to about 25 micrometers, or even about 8 micrometers to about 20 micrometers. In some embodiments, the crystalline ceramic fibers have an average tensile strength of at least 1.4 GPa, at least 1.7 GPa, at least 2.1 GPa, and or even at least 2.8 GPa. In some embodiments, the crystalline ceramic fibers have a modulus greater than 70 GPa to approximately no greater than 1000 GPa, or even no greater than 420 GPa.

Examples of suitable monofilament ceramic fibers include silicon carbide fibers. Typically, the silicon carbide monofilament fibers are crystalline and/or a mixture of crystalline ceramic and glass (i.e., a fiber may contain both crystalline ceramic and glass phases). Typically, such fibers have a length on the order of at least 50 meters, and may even have lengths on the order of kilometers or more. Typically, the continuous silicon carbide monofilament fibers have an average fiber diameter in a range from about 100 micrometers to about 250 micrometers. In some embodiments, the crystalline ceramic fibers have an average tensile strength of at least 2.8 GPa, at least 3.5 GPa, at least 4.2 GPa and or even at least 6 GPa. In some embodiments, the crystalline ceramic fibers have a modulus greater than 250 GPa to approximately no greater than 500 GPa, or even no greater than 430 GPa.

Suitable alumina fibers are described, for example, in U.S. Pat. No. 4,954,462 (Wood et al.) and U.S. Pat. No. 5,185,299 (Wood et al.). In some embodiments, the alumina fibers are polycrystalline alpha alumina fibers and comprise, on a theoretical oxide basis, greater than 99 percent by weight $Al_2O_3$ and 0.2-0.5 percent by weight $SiO_2$, based on the total weight of the alumina fibers. In another aspect, some desirable polycrystalline, alpha alumina fibers comprise alpha alumina having an average grain size of less than one micrometer (or even, in some embodiments, less than 0.5 micrometer). In another aspect, in some embodiments, polycrystalline, alpha alumina fibers have an average tensile strength of at least 1.6 GPa (in some embodiments, at least 2.1 GPa, or even, at least 2.8 GPa). Exemplary alpha alumina fibers are marketed under the trade designation "NEXTEL 610" (3M Company, St. Paul, Minn.).

Suitable aluminosilicate fibers are described, for example, in U.S. Pat. No. 4,047,965 (Karst et al). Exemplary aluminosilicate fibers are marketed under the trade designations "NEXTEL 440", "NEXTEL 550", and "NEXTEL 720" by 3M Company of St. Paul, Minn. Aluminoborosilicate fibers are described, for example, in U.S. Pat. No. 3,795,524 (Sowman). Exemplary aluminoborosilicate fibers are marketed under the trade designation "NEXTEL 312" by 3M Company. Boron nitride fibers can be made, for example, as described in U.S. Pat. No. 3,429,722 (Economy) and U.S. Pat. No. 5,780,154 (Okano et al.). Exemplary silicon carbide fibers are marketed, for example, by COI Ceramics of San Diego, Calif. under the trade designation "NICALON" in tows of 500 fibers, from Ube Industries of Japan, under the trade designation "TYRANNO", and from Dow Corning of Midland, Mich. under the trade designation "SYLRAMIC".

Suitable carbon fibers include commercially available carbon fibers such as the fibers designated as PANEX® and PYRON® (available from ZOLTEK, Bridgeton, Mo.), THORNEL (available from CYTEC Industries, Inc., West Paterson, N.J.), HEXTOW (available from HEXCEL, Inc., Southbury, Conn.), and TORAYCA (available from TORAY Industries, Ltd. Tokyo, Japan). Such carbon fibers may be derived from a polyacrylonitrile (PAN) precursor. Other suitable carbon fibers include PAN-IM, PAN-HM, PAN UHM, PITCH or rayon byproducts, as known in the art.

Additional suitable commercially available fibers include ALTEX (available from Sumitomo Chemical Company, Osaka, Japan), and ALCEN (available from Nitivy Company, Ltd., Tokyo, Japan).

Suitable fibers also include shape memory alloy (i.e., a metal alloy that undergoes a Martensitic transformation such that the metal alloy is deformable by a twinning mechanism below the transformation temperature, wherein such deformation is reversible when the twin structure reverts to the original phase upon heating above the transformation temperature). Commercially available shape memory alloy fibers are available, for example, from Johnson Matthey Company (West Whiteland, Pa.).

In some embodiments the ceramic fibers are in tows. Tows are known in the fiber art and refer to a plurality of (individual) fibers (typically at least 100 fibers, more typically at least 400 fibers) collected in a roving-like form. In some embodiments, tows comprise at least 780 individual fibers per tow, in some cases at least 2600 individual fibers per tow, and in other cases at least 5200 individual fibers per tow. Tows of ceramic fibers are generally available in a variety of lengths, including 300 meters, 500 meters, 750 meters, 1000 meters, 1500 meters, 2500 meters, 5000 meters, 7500 meters, and longer. The fibers may have a cross-sectional shape that is circular or elliptical.

Commercially available fibers may typically include an organic sizing material added to the fiber during manufacture to provide lubricity and to protect the fiber strands during handling. The sizing may be removed, for example, by dissolving or burning the sizing away from the fibers. Typically, it is desirable to remove the sizing before forming metal matrix composite wire. The fibers may also have coatings used, for example, to enhance the wettability of the fibers, to reduce or prevent reaction between the fibers and molten metal matrix material. Such coatings and techniques for providing such coatings are known in the fiber and composite art.

In further exemplary embodiments, each of the composite wires is selected from a metal matrix composite wire and a polymer composite wire. Suitable composite wires are disclosed, for example, in U.S. Pat. Nos. 6,180,232; 6,245,425; 6,329,056; 6,336,495; 6,344,270; 6,447,927; 6,460,597; 6,544,645; 6,559,385, 6,723,451; and 7,093,416, the entire disclosures of each are incorporated herein by reference.

One presently preferred fiber reinforced metal matrix composite wire is a ceramic fiber reinforced aluminum matrix composite wire. The ceramic fiber reinforced aluminum matrix composite wires preferably comprise continuous fibers of polycrystalline $\alpha$-$Al_2O_3$ encapsulated within a matrix of either substantially pure elemental aluminum or an alloy of pure aluminum with up to about 2% by weight copper, based on the total weight of the matrix. The preferred fibers comprise equiaxed grains of less than about 100 nm in size, and a fiber diameter in the range of about 1-50 micrometers. A fiber diameter in the range of about 5-25 micrometers is preferred with a range of about 5-15 micrometers being most preferred.

Preferred fiber reinforced composite wires to the present disclosure have a fiber density of between about 3.90-3.95 grams per cubic centimeter. Among the preferred fibers are those described in U.S. Pat. No. 4,954,462 (Wood et al., assigned to Minnesota Mining and Manufacturing Company, St. Paul, Minn.), the teachings of which are hereby incorporated by reference. Preferred fibers are available commercially under the trade designation "NEXTEL 610" alpha alumina based fibers (available from 3M Company, St. Paul, Minn.). The encapsulating matrix is selected to be such that it does not significantly react chemically with the fiber material (i.e., is relatively chemically inert with respect the fiber material, thereby eliminating the need to provide a protective coating on the fiber exterior.

In certain presently preferred embodiments of a composite wire, the use of a matrix comprising either substantially pure elemental aluminum, or an alloy of elemental aluminum with up to about 2% by weight copper, based on the total weight of the matrix, has been shown to produce successful wires. As used herein the terms "substantially pure elemental aluminum", "pure aluminum" and "elemental aluminum" are interchangeable and are intended to mean aluminum containing less than about 0.05% by weight impurities.

In one presently preferred embodiment, the composite wires comprise between about 30-70% by volume polycrystalline $\alpha$-$Al_2O_3$ fibers, based on the total volume of the composite wire, within a substantially elemental aluminum matrix. It is presently preferred that the matrix contains less than about 0.03% by weight iron, and most preferably less than about 0.01% by weight iron, based on the total weight of the matrix. A fiber content of between about 40-60% polycrystalline $\alpha$-$Al_2O_3$ fibers is preferred. Such composite wires, formed with a matrix having a yield strength of less than about 20 MPa and fibers having a longitudinal tensile strength of at least about 2.8 GPa have been found to have excellent strength characteristics.

The matrix may also be formed from an alloy of elemental aluminum with up to about 2% by weight copper, based on the total weight of the matrix. As in the embodiment in which a substantially pure elemental aluminum matrix is used, composite wires having an aluminum/copper alloy matrix preferably comprise between about 30-70% by volume polycrystalline $\alpha$-$Al_2O_3$ fibers, and more preferably therefore about 40-60% by volume polycrystalline $\alpha$-$Al_2O_3$ fibers, based on the total volume of the composite. In addition, the matrix preferably contains less than about 0.03% by weight iron, and most preferably less than about 0.01% by weight iron based on the total weight of the matrix. The aluminum/copper matrix preferably has a yield strength of less than about 90 MPa, and, as above, the polycrystalline $\alpha$-$Al_2O_3$ fibers have a longitudinal tensile strength of at least about 2.8 GPa.

Composite wires preferably are formed from substantially continuous polycrystalline $\alpha$-$Al_2O_3$ fibers contained within the substantially pure elemental aluminum matrix or the matrix formed from the alloy of elemental aluminum and up to about 2% by weight copper described above. Such wires are made generally by a process in which a spool of substantially continuous polycrystalline $\alpha$-$Al_2O_3$ fibers, arranged in a fiber tow, is pulled through a bath of molten matrix material. The resulting segment is then solidified, thereby providing fibers encapsulated within the matrix.

Exemplary metal matrix materials include aluminum (e.g., high purity, (e.g., greater than 99.95%) elemental aluminum, zinc, tin, magnesium, and alloys thereof (e.g., an alloy of aluminum and copper). Typically, the matrix material is selected such that the matrix material does not significantly chemically react with the fiber (i.e., is relatively chemically inert with respect to fiber material), for example, to eliminate the need to provide a protective coating on the fiber exterior. In some embodiments, the matrix material desirably includes aluminum and alloys thereof.

In some embodiments, the metal matrix comprises at least 98 percent by weight aluminum, at least 99 percent by weight aluminum, greater than 99.9 percent by weight aluminum, or even greater than 99.95 percent by weight aluminum. Exemplary aluminum alloys of aluminum and copper comprise at least 98 percent by weight Al and up to 2 percent by weight Cu. In some embodiments, useful alloys are 1000, 2000, 3000, 4000, 5000, 6000, 7000 and/or 8000 series aluminum alloys (Aluminum Association designations). Although higher purity metals tend to be desirable for making higher tensile strength wires, less pure forms of metals are also useful.

Suitable metals are commercially available. For example, aluminum is available under the trade designation "SUPER PURE ALUMINUM; 99.99% Al" from Alcoa of Pittsburgh, Pa. Aluminum alloys (e.g., Al-2% by weight Cu (0.03% by weight impurities)) can be obtained, for example, from Belmont Metals, New York, N.Y. Zinc and tin are available, for example, from Metal Services, St. Paul, Minn. ("pure zinc"; 99.999% purity and "pure tin"; 99.95% purity). For example, magnesium is available under the trade designation "PURE" from Magnesium Elektron, Manchester, England. Magnesium alloys (e.g., WE43A, EZ33A, AZ81A, and ZE41A) can be obtained, for example, from TIMET, Denver, Colo.

The metal matrix composite wires typically comprise at least 15 percent by volume (in some embodiments, at least 20, 25, 30, 35, 40, 45, or even 50 percent by volume) of the fibers, based on the total combined volume of the fibers and matrix material. More typically the composite cores and wires comprise in the range from 40 to 75 (in some embodiments, 45 to 70) percent by volume of the fibers, based on the total combined volume of the fibers and matrix material.

Metal matrix composite wires can be made using techniques known in the art. Continuous metal matrix composite wire can be made, for example, by continuous metal matrix infiltration processes. One suitable process is described, for example, in U.S. Pat. No. 6,485,796 (Carpenter et al.), the entire disclosure of which is incorporated herein by reference. Wires comprising polymers and fiber may be made by pultrusion processes which are known in the art.

In additional exemplary embodiments, the composite wires are selected to include polymer composite wires. The polymer composite wires comprise at least one continuous fiber in a polymer matrix. In some exemplary embodiments, the at least one continuous fiber comprises metal, carbon, ceramic, glass, and combinations thereof. In certain presently preferred embodiments, the at least one continuous fiber comprises titanium, tungsten, boron, shape memory alloy, carbon nanotubes, graphite, silicon carbide, boron, aramid, poly(p-phenylene-2,6-benzobisoxazole)3, and combinations thereof. In additional presently preferred embodiments, the polymer matrix comprises a (co)polymer selected from an epoxy, an ester, a vinyl ester, a polyimide, a polyester, a cyanate ester, a phenolic resin, a bis-maleimide resin, and combinations thereof.

Ductile metal wires for stranding around a composite core to provide a composite cable, e.g. an electrical power transmission cable according to certain embodiments of the present disclosure, are known in the art. Preferred ductile metals include iron, steel, zirconium, copper, tin, cadmium, aluminum, manganese, and zinc; their alloys with other metals and/or silicon; and the like. Copper wires are commercially available, for example from Southwire Company, Carrolton, Ga. Aluminum wires are commercially available, for example from Nexans, Weyburn, Canada or Southwire Company, Carrolton, Ga. under the trade designations "1350-H19 ALUMINUM" and "1350-H0 ALUMINUM".

Typically, copper wires have a thermal expansion coefficient in a range from about 12 ppm/° C. to about 18 ppm/° C. over at least a temperature range from about 20° C. to about 800° C. Copper alloy (e.g. copper bronzes such as Cu—Si—X, Cu—Al—X, Cu—Sn—X, Cu—Cd; where X=Fe, Mn, Zn, Sn and or Si; commercially available, for example from Southwire Company, Carrolton, Ga.; oxide dispersion strengthened copper available, for example, from OMG Americas Corporation, Research Triangle Park, N.C., under the designation "GLIDCOP") wires. In some embodiments, copper alloy wires have a thermal expansion coefficient in a range from about 10 ppm/° C. to about 25 ppm/° C. over at least a temperature range from about 20° C. to about 800° C. The wires may be in any of a variety shapes (e.g., circular, elliptical, and trapezoidal).

Typically, aluminum wire have a thermal expansion coefficient in a range from about 20 ppm/° C. to about 25 ppm/° C. over at least a temperature range from about 20° C. to about 500° C. In some embodiments, aluminum wires (e.g., "1350-H19 ALUMINUM") have a tensile breaking strength, at least 138 MPa (20 ksi), at least 158 MPa (23 ksi), at least 172 MPa (25 ksi) or at least 186 MPa (27 ksi) or at least 200 MPa (29 ksi). In some embodiments, aluminum wires (e.g., "1350-H0 ALUMINUM") have a tensile breaking strength greater than 41 MPa (6 ksi) to no greater than 97 MPa (14 ksi), or even no greater than 83 MPa (12 ksi).

Aluminum alloy wires are commercially available, for example, aluminum-zirconium alloy wires sold under the trade designations "ZTAL," "XTAL," and "KTAL" (available from Sumitomo Electric Industries, Osaka, Japan), or "6201" (available from Southwire Company, Carrolton, Ga.). In some embodiments, aluminum alloy wires have a thermal expansion coefficient in a range from about 20 ppm/° C. to about 25 ppm/° C. over at least a temperature range from about 20° C. to about 500° C.

The present disclosure is preferably carried out so as to provide very long stranded cables. It is also preferable that the composite wires within the stranded cable 10 themselves are continuous throughout the length of the stranded cable. In one preferred embodiment, the composite wires are substantially continuous and at least 150 meters long. More preferably, the composite wires are continuous and at least 250 meters long, more preferably at least 500 meters, still more preferably at least 750 meters, and most preferably at least 1000 meters long in the stranded cable 10.

In an additional aspect, the disclosure provides a method of making the stranded composite cables described above, the method comprising stranding a first plurality of composite wires about a single wire defining a center longitudinal axis, wherein stranding the first plurality of composite wires is carried out in a first lay direction at a first lay angle defined relative to the center longitudinal axis, and wherein the first plurality of composite wires has a first lay length; and stranding a second plurality of composite wires around the first plurality of composite wires, wherein stranding the second plurality of composite wires is carried out in the first lay direction at a second lay angle defined relative to the center longitudinal axis, and wherein the second plurality of composite wires has a second lay length, further wherein a relative difference between the first lay angle and the second lay angle is no greater than 4°. In one presently preferred embodiment, the method further comprises stranding a plurality of ductile wires around the composite wires.

The composite wires may be stranded or helically wound as is known in the art on any suitable cable stranding equipment, such as planetary cable stranders available from Cortinovis, Spa, of Bergamo, Italy, and from Watson Machinery International, of Patterson, N.J. In some embodiments, it may be advantageous to employ a rigid strander as is known in the art.

While any suitably-sized composite wire can be used, it is preferred for many embodiments and many applications that the composite wires have a diameter from 1 mm to 4 mm, however larger or smaller composite wires can be used.

In one preferred embodiment, the stranded composite cable includes a plurality of stranded composite wires that are helically stranded in a lay direction to have a lay factor of from 10 to 150. The "lay factor" of a stranded cable is determined by dividing the length of the stranded cable in which a single wire 12 completes one helical revolution by the nominal outside of diameter of the layer that includes that strand.

During the cable stranding process, the center wire, or the intermediate unfinished stranded composite cable which will have one or more additional layers wound about it, is pulled through the center of the various carriages, with each carriage adding one layer to the stranded cable. The individual wires to be added as one layer are simultaneously pulled from their respective bobbins while being rotated about the center axis of the cable by the motor driven carriage. This is done in sequence for each desired layer. The result is a helically stranded core. Optionally, a maintaining means, such as tape, for example, can be applied to the resulting stranded composite core to aid in holding the stranded wires together.

Figure 6:
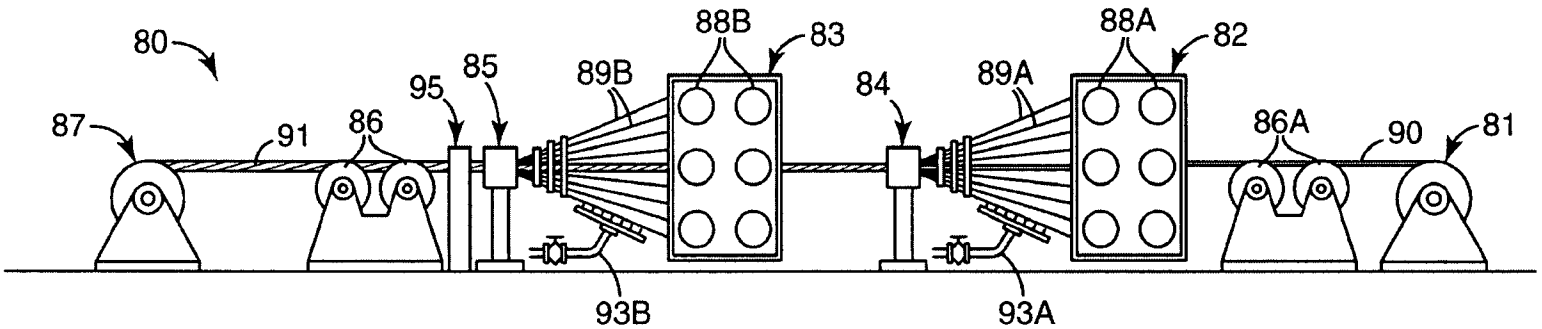
FIG. 6 is a schematic view of an exemplary stranding apparatus used to make cable in accordance with additional exemplary embodiments of the present disclosure.

An exemplary apparatus 80 for making stranded composite cables according to embodiments of the present disclosure is shown in FIG. 6. In general, stranded composite cables according to the present disclosure can be made by stranding composite wires around a single wire in the same lay direction, as described above. The single wire may comprise a composite wire or a ductile wire. At least two layers of composite wires are formed by stranding composite wires about the single wire core, for example, 19 or 37 wires formed in at least two layers around a single center wire, as shown in FIG. 1B.

A spool of wire 81 is provided at the head of conventional planetary stranding machine 80, wherein spool 81 is free to rotate, with tension capable of being applied via a braking system where tension can be applied to the core during payoff (in some embodiments, in the range of 0-91 kg (0-200 lbs.)). Single wire 90 is threaded through bobbin carriages 82, 83, through the closing dies 84, 85, around capstan wheels 86 and attached to take-up spool 87.

Prior to the application of the outer stranding layers, individual composite wires are provided on separate bobbins 88 which are placed in a number of motor driven carriages 82, 83of the stranding equipment. In some embodiments, the range of tension required to pull wire 89A, 89B from the bobbins 88 is typically 4.5-22.7 kg (10-50 lbs.). Typically, there is one carriage for each layer of the finished stranded composite cable. Wires 89A, 89B of each layer are brought together at the exit of each carriage at a closing die 84, 85 and arranged over the center wire or over the preceding layer.

Layers of composite wires comprising the composite cable are helically stranded in the same direction as previously described. During the composite cable stranding process, the center wire, or the intermediate unfinished stranded composite cable which may have one or more additional layers wound about it, is pulled through the center of the various carriages, with each carriage adding one layer to the stranded cable. The individual wires to be added as one layer are simultaneously pulled from their respective bobbins while being rotated about the center axis of the cable by the motor driven carriage. This is done in sequence for each desired layer. The result is a helically stranded composite cable 91 that can be cut and handled conveniently without loss of shape or unraveling.

In some exemplary embodiments, stranded composite cables comprise stranded composite wires having a length of at least 100 meters, at least 200 meters, at least 300 meters, at least 400 meters, at least 500 meters, at least 1000 meters, at least 2000 meters, at least 3000 meters, or even at least 4500 meters or more.

The ability to handle the stranded cable is a desirable feature. Although not wanting to be bound by theory, the cable maintains its helically stranded arrangement because during manufacture, the metallic wires are subjected to stresses, including bending stresses, beyond the yield stress of the wire material but below the ultimate or failure stress. This stress is imparted as the wire is helically wound about the relatively small radius of the preceding layer or center wire. Additional stresses are imparted at closing dies 84, 85 which apply radial and shear forces to the cable during manufacture. The wires therefore plastically deform and maintain their helically stranded shape.

The single center wire material and composite wires for a given layer are brought into intimate contact via closing dies. Referring to FIG. 6, closing dies 84, 85 are typically sized to minimize the deformation stresses on the wires of the layer being wound. The internal diameter of the closing die is tailored to the size of the external layer diameter. To minimize stresses on the wires of the layer, the closing die is sized such that it is in the range from 0-2.0% larger, relative to the external diameter of the cable. (i.e., the interior die diameters are in a range of 1.00 to 1.02 times the exterior cable diameter). Exemplary closing dies are cylinders, and are held in position, for example, using bolts or other suitable attachments. The dies can be made, for example, of hardened tool steel.

The resulting finished stranded composite cable may pass through other stranding stations, if desired, and ultimately wound onto take-up spool 87 of sufficient diameter to avoid cable damage. In some embodiments, techniques known in the art for straightening the cable may be desirable. For example, the finished cable can be passed through a straightener device comprised of rollers (each roller being for example, 10-15 cm (4-6 inches), linearly arranged in two banks, with, for example, 5-9 rollers in each bank. The distance between the two banks of rollers may be varied so that the rollers just impinge on the cable or cause severe flexing of the cable. The two banks of rollers are positioned on opposing sides of the cable, with the rollers in one bank matching up with the spaces created by the opposing rollers in the other bank. Thus, the two banks can be offset from each other. As the cable passes through the straightening device, the cable flexes back and forth over the rollers, allowing the strands in the conductor to stretch to the same length, thereby reducing or eliminating slack strands.

In some embodiments, it may be desirable to provide the single center wire at an elevated temperature (e.g., at least 25° C., 50° C., 75° C., 100° C., 125° C., 150° C., 200° C., 250° C., 300° C., 400° C., or even, in some embodiments, at least 500° C.) above ambient temperature (e.g., 22° C.). The single center wire can be brought to the desired temperature, for example, by heating spooled wire (e.g., in an oven for several hours). The heated spooled wire is placed on the pay-off spool (see, e.g., pay-off spool 81 in FIG. 6) of a stranding machine. Desirably, the spool at elevated temperature is in the stranding process while the wire is still at or near the desired temperature (typically within about 2 hours).

Further it may be desirable, for the composite wires on the payoff spools that form the outer layers of the cable, to be at the ambient temperature. That is, in some embodiments, it may be desirable to have a temperature differential between the single wire and the composite wires which form the outer composite layers during the stranding process. In some embodiments, it may be desirable to conduct the stranding with a single wire tension of at least 100 kg, 200 kg, 500 kg, 1000 kg., or even at least 5000 kg.

Stranded cables of the present disclosure are useful in numerous applications. Such stranded cables are believed to be particularly desirable for use in electrical power transmission cables, which may include overhead and underground electrical power transmission cables, due to their combination of low weight, high strength, good electrical conductivity, low coefficient of thermal expansion, high use temperatures, and resistance to corrosion.

Figure 7:
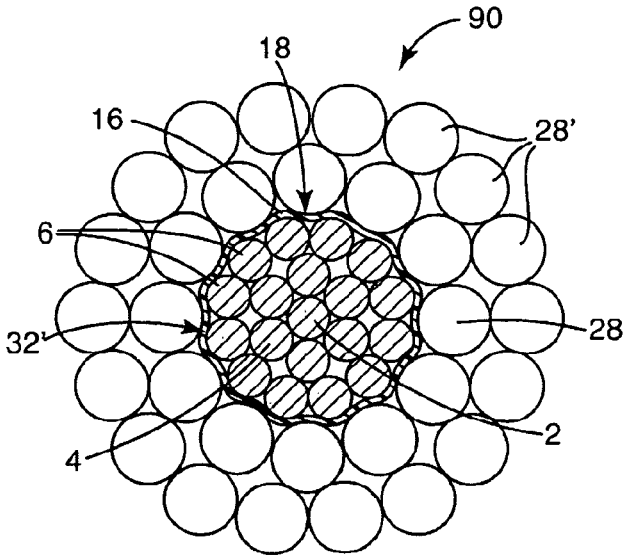
FIG. 7 is a cross-sectional end view of a helically stranded composite cable including a maintaining means around the stranded composite wire core, and one or more layers comprising a plurality of ductile wires stranded around the stranded composite wire core according to additional exemplary embodiments of the present disclosure.

FIG. 7 is a cross-sectional end view of a helically stranded composite cable 80 including one or more layers comprising a plurality of ductile wires (28, 28') stranded around a core 32' (FIG. 5C) comprising helically stranded composite wires (2, 4, 6, 8) stranded in the same lay direction and held in place by a maintaining means such as tape 18 wrapped around at least the second layer of stranded composite wires 16 according to another exemplary embodiment of the present disclosure.

Such a helically stranded composite cable is particularly useful as an electrical power transmission cable. When used as an electrical power transmission cable, the ductile wires (28, 28') act as electrical conductors, i.e. ductile wire conductors. As illustrated, the electrical power transmission cable may include two layers of ductile conductor wires (28, 28'). More layers of conductor wires (not shown in FIG. 7) may be used as desired. Preferably, each conductor layer comprises a plurality of conductor wires (28, 28') as is known in the art. Suitable materials for the ductile conductor wires (28, 28') includes aluminum and aluminum alloys. The ductile conductor wires (28, 28') may be stranded about the stranded composite core (e.g. 32') by suitable cable stranding equipment as is known in the art (see, e.g. FIG. 6).

The weight percentage of composite wires within the electrical power transmission cable will depend upon the design of the transmission line. In the electrical power transmission cable, the aluminum or aluminum alloy conductor wires may be any of the various materials known in the art of overhead power transmission, including, but not limited to, 1350 Al (ASTM B609-91), 1350-H19 Al (ASTM B230-89), or 6201 T-81 Al (ASTM B399-92).

For a description of suitable electrical power transmission cables and processes in which the stranded cable of the present disclosure may be used, see, for example, Standard Specification for Concentric Lay Stranded Aluminum Conductors, Coated, Steel Reinforced (ACSR) ASTM B232-92; or U.S. Pat. Nos. 5,171,942 and 5,554,826. A preferred embodiment of the electrical power transmission cable is an overhead electrical power transmission cable. In these applications, the materials for the maintaining means should be selected for use at temperatures of at least 100° C., or 240° C., or 300° C., depending on the application. For example, the maintaining means should not corrode the aluminum conductor layer, or give off undesirable gasses, or otherwise impair the transmission cable at the anticipated temperatures during use.

In other applications, in which the stranded cable is to be used as a final article itself, or in which it is to be used as an intermediary article or component in a different subsequent article, it is preferred that the stranded cable be free of electrical power conductor layers around the plurality of composite wires.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

Example 1

For this example, the starting material consisted of 12 foot (3.7 m) lengths cut from a reel of normal production 3M ACCR aluminum-matrix composite (AMC) cable (type 795-T16, available from 3M Company, St. Paul, Minn.). This construction comprises a core containing 19 AMC wires (produced by 3M Company, St. Paul, Minn.) having a diameter of 0.084 inch (2.13 mm), surrounded by 26 Al—Zr (aluminum-zirconium) metal wires drawn from Al—Zr rod (produced by Lamifil, Inc., Hemiksem, Belguim) and having a diameter of 0.175 inch (4.45 mm). The basic construction of this cable is shown in FIG. 4B.

To build a test sample of composite cable according to embodiments of the present disclosure, the starting 12 foot (3.7 m) length of normal-production cable was first disassembled into its constituent wires, taking care to avoid altering the existing helical shape of the Al—Zr wires. Next, the two helical layers of the core were constructed to the desired lay length and orientation using a simple tabletop fixture. For each layer, the wires were first secured at one end to a hand-cranked cap and then threaded though a "rosette"-shaped guide plate to spread the individual composite wires into an arrangement suitable for stranding. In quarter-turn steps, the crank was simultaneously turned by one operator, while another operator moved the wire guide along the table following marked quarter-lay-length intervals.

After this operation was completed for the inner core layer, its free end was temporarily taped to keep it in place, and the process was repeated for the outer core layer. The stranded 19-wire core was then wrapped with type 363 metal foil/glass cloth tape (available from 3M Company, St. Paul, Minn.) having a thickness of 7.3 mils (182.5 micrometers) and a width of ¾ inch (1.9 cm) to give a finished taped composite core.

Starting from the finished tape-wrapped composite wire core, it was relatively simple to re-strand the Al—Zr wires into place, one at a time, given their retained helical shape. With care, these wires simply snapped back into position, at their original lay lengths and at very close to the original overall cable diameter. Once assembly was completed, the ends of a 10 foot (3.1 m) long central portion were secured using filament tape, and the extra material at each end was trimmed away using an abrasive-wheel saw.

Using the above method, a total of 12 experimental samples were prepared at six stranding conditions covering varying lay lengths and lay angles and including both left hand lay direction (designated "L") and right hand lay direction (designated "R"), as summarized in Table 1.

TABLE 1

| Stranded Composite Cable 10 | | | | | | | | | | | |
|---|---|---|---|---|---|---|---|---|---|---|---|
| | | Inner Core Construction | | | | Outer Core Construction | | | | | |
| Condition | Samples | Lay Direction | Lay Length (in) | Lay Length (cm) | Lay Angle (deg) | Lay Direction | Lay Length (in) | Lay Length (cm) | Lay Angle (deg) | Relative Lay Length | Crossing angle (deg) |
| 1 | LLO-1, LLO-2 | L | 16.5 | 42 | −1.84 | R | 27.4 | 70 | 2.21 | 1.00 | 4.05 |
| 2 | LLO-3, LLO-4 | L | 70 | 178 | −0.43 | R | 27.4 | 70 | 2.21 | 1.00 | 2.64 |
| 3 | LLO-5, LLO-6 | R | 16.5 | 42 | 1.84 | R | 27.4 | 70 | 2.21 | 1.00 | 0.37 |
| 4 | LLO-7, LLO-8 | L | 19.9 | 51 | −1.52 | R | 33.2 | 84 | 1.83 | 1.21 | 3.35 |
| 5 | LLO-9, LLO-10 | L | 25.0 | 64 | −1.21 | R | 41.0 | 104 | 1.48 | 1.50 | 2.69 |
| 6 | LLO-11, LLO-12 | R | 25.0 | 64 | 1.21 | R | 41.0 | 104 | 1.48 | 1.50 | 0.27 |

The six stranding conditions may be viewed as a roughly-orthogonal design on inner-core lay angle and relative outer-core lay length, as described below. However, as shown in the final column of the above table, both of these variables influence the crossing angle (i.e., the relative difference between the lay angles of the adjacent inner and outer layers of helically stranded wire) between inner and outer core wires, which may be important to the mechanism resulting in improved composite cable tensile strength.

For all of the exemplary composite cables samples prepared, the inner Al—Zr conductor wire layer has a left-hand lay direction at a target lay length of 10.0 inch (25.4 cm), and the outer Al—Zr conductor wire layer has a right-hand lay direction at a target lay length of 13.0 inch (33.0 cm). Measured average values for these layers differ from target by 0.65 inch (1.6 cm) or less, well within the desired stranding specifications. Final diameters of the conductor cable samples ranged from 1.122 inch to 1.136 inch (28.50 to 28.85 mm), not far from the original diameter of 1.124 inch (28.55 mm).

Tensile strength testing was carried out by Wire Rope Industries (Pointe-Claire, Quebec, Canada) under a written obligation of confidentiality to 3M Company. The sample preparation and testing methods used were similar to those laid out in 3M TM505, "Preparation of ACCR Samples Using Resin End Terminations" (Available from 3M Company, St. Paul, Minn.). An outline of this test method is given in the following paragraphs.

First, any curvature within about 2 feet (0.6 m) of one end of the cable sample was removed by careful "back-bending" of the cable at close intervals. At a specified "end length" from this end (typically about 10 inch (25 cm)), a hose clamp was then applied to prevent any disturbance of the wires within the inner test span. A thick layer of duct tape was then wrapped adjacent to this clamp, to serve as both a seal and a centering device in the resin-casting die. The ends of the Al—Zr wires were then carefully spread out ("broomed") into a conical shape at a maximum angle of about 30°, and the exposed core tape was removed to allow the core wires to spread out naturally. If there were any oily residues on the wires from earlier operations, the wires were cleaned using acetone, 2-butanone, or a similar solvent, followed by thorough drying. If the wires were already clean, this step was not necessary.

The prepared cable end was then positioned inside a split-shell socket. Note that this socket has a tapered bore, as well as holes designed for later securing it into a tensile testing machine. The two shell halves were then clamped together, capturing about 1 inch (2.5 cm) of the tape wrap to form a leak-free seal. The Al—Zr wires were then trimmed off at a level just above the end of the socket, but the full lengths of the core wires were left intact.

The socket was then mounted vertically, with the cable sample hanging from the bottom. A freshly-prepared batch of two-part "Wirelock" Socket Compound (Millfield Enterprises Ltd., Newburn, Newcastle-upon-Tyne, England) was then poured into the socket to completely fill it. Once the compound had gelled (about 15 minutes), a cardboard extension tube was added around the exposed core wires. Then, more Wirelock compound was prepared, and the extension tube was also filled. After allowing the assembly to cure undisturbed for a minimum of 45 minutes, all steps were then repeated for the other end of the cable sample. Another 12 hours was allowed to obtain full resin curing prior to the tensile test.

The finished test sample was then mounted into the tensile testing machine. This machine is capable of reaching the expected breaking load of the sample at a controlled rate, using either a specified crosshead speed or a specified force rate, and had a properly-calibrated load cell. Care was taken to ensure that the sample was mounted with the two sockets closely aligned along the machine axis to minimize bending loads. The hose clamps were removed from the sample and a mild pre-tension was applied, typically 500-1000 lbs (4.5-9.0 kN). Sample alignment was verified, and the cable ends were wiggled to help release any friction or binding.

After closing all safety doors around the test enclosure, tensile testing to the point of sample failure was carried out at a loading rate corresponding to a true sample strain rate of 1% per minute. The peak load was recorded as the tensile strength of each test sample. Note that test results may be invalidated if sample failure occurs within the resin cone, or if wires have slipped within the resin, or in the case of poor sample preparation or extraneous sample damage. In such event, the sample results were not used. All tensile test results obtained for the examples are tabulated in Table 2, below. Note that, for this cable construction, the specified rated breaking strength (RBS) is 31,134 $lb_f$ (14,134.9 $kgz_f$).

TABLE 2

| Power Electrical power transmission cable | | | | | | |
|---|---|---|---|---|---|---|
| Condition | Sample | Inner-Core Lay Angle (deg) | Relative Lay Length | Crossing Angle (deg) | Tensile Strength (lb) | Relative Tensile Strength (% RBS) |
| 1 | LLO-1 | −1.84 | 1.00 | 4.05 | 30600 | 98.3% |
| 1 | LLO-2 | −1.84 | 1.00 | 4.05 | 30400 | 97.6% |
| 2 | LLO-3 | −0.43 | 1.00 | 2.64 | 32400 | 104.1% |
| 2 | LLO-4 | −0.43 | 1.00 | 2.64 | 32200 | 103.4% |
| 3 | LLO-5 | 1.84 | 1.00 | 0.37 | 34100 | 109.5% |
| 3 | LLO-6 | 1.84 | 1.00 | 0.37 | 34200 | 109.8% |
| 4 | LLO-7 | −1.52 | 1.21 | 3.35 | 31000 | 99.6% |
| 4 | LLO-8 | −1.52 | 1.21 | 3.35 | 31300 | 100.5% |
| 5 | LLO-9 | −1.21 | 1.50 | 2.69 | 32700 | 105.0% |
| 5 | LLO-10 | −1.21 | 1.50 | 2.69 | 32900 | 105.7% |
| 6 | LLO-11 | 1.21 | 1.50 | 0.27 | 33100 | 106.3% |
| 6 | LLO-12 | 1.21 | 1.50 | 0.27 | 34000 | 109.2% |

Figure 8:
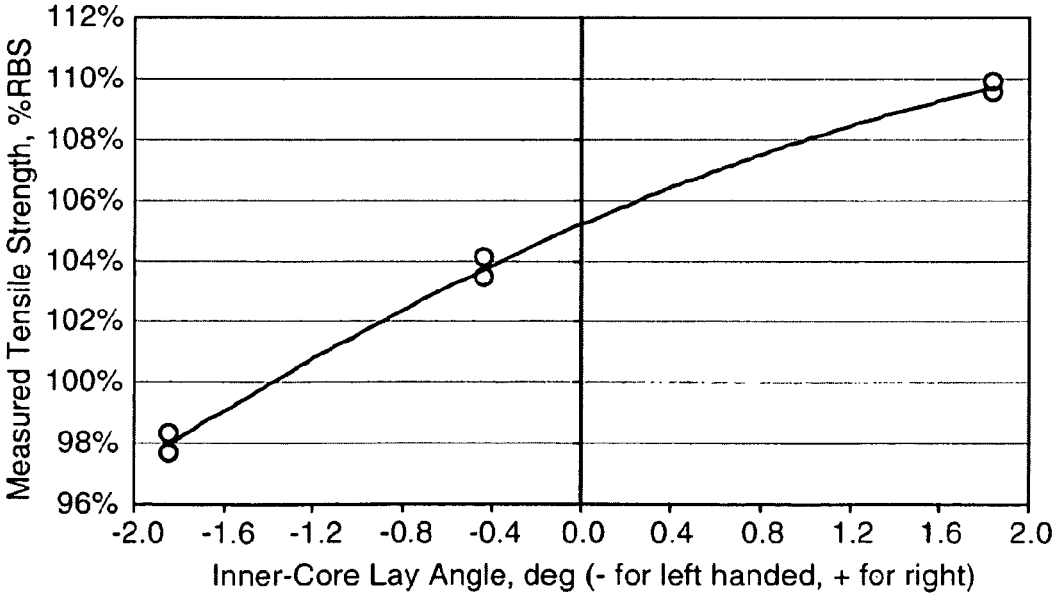
FIG. 8 is a plot of the effect of relative difference in lay angle between inner and outer wire layers on measured tensile strength for exemplary helically stranded composite cables of the present disclosure.

FIG. 8 shows a plot of the effect of the relative difference in lay angle between inner and outer wire layers (Inner-Core Lay Angle), on measured tensile strength for exemplary helically stranded composite cables of the present disclosure. Using the results for conditions 1, 2, and 3, FIG. 8 shows the response of tensile strength to changes in the inner-core lay angle. The trend is statistically highly significant, and is described by a quadratic fit with an adjusted coefficient of determination ($R^2$) of 0.994.

Figure 9:
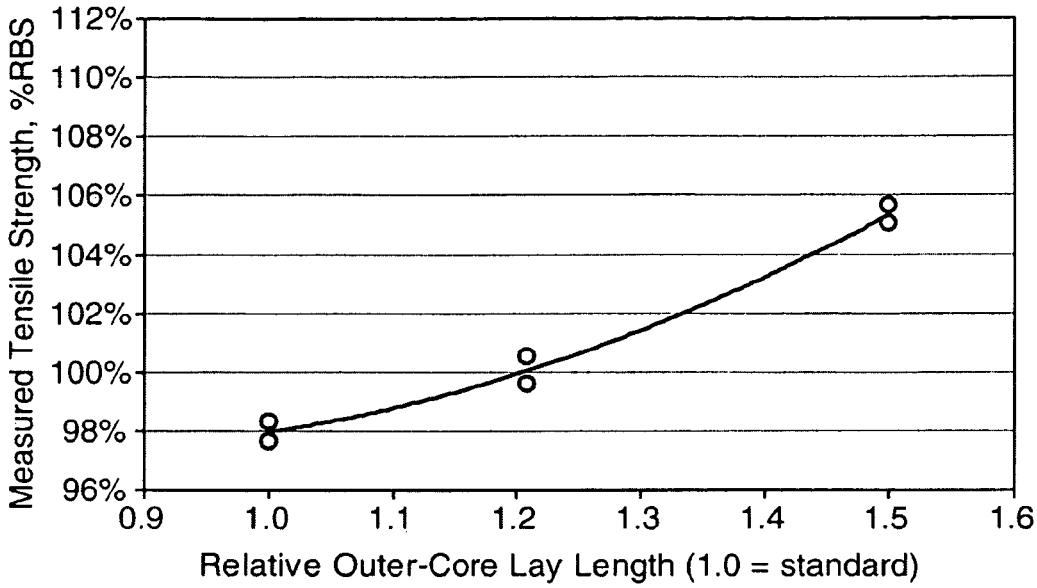
FIG. 9 is a plot of the effect of relative difference in lay length between outer and inner wire layers on the measured tensile strength for exemplary helically stranded composite cables of the present disclosure.

FIG. 9 shows a plot of the effect of relative difference in lay length between outer and inner wire layers (Relative Outer-Core Lay Length) on the measured tensile strength for exemplary helically stranded composite cables of the present disclosure. Again, the trend is statistically highly significant, and is described by a quadratic fit with an adjusted coefficient of determination ($R^2$) of 0.975.

There are a number of surprising aspects of FIG. 9. First, the observed increase in cable tensile strength with a 50% increase in relative lay length (7.4% RBS) is much larger than would be predicted by the original circular-helix bending strain calculations. Consequently, maximum bending strain would be reduced from 0.00052 to 0.00022, translating to about a 4.5% improvement in the tensile strength of the composite core alone. Since the composite core supports about 60% of the total conductor load at failure, this would predict a total increase in conductor strength of only about 2.6%. Furthermore, the tensile strength results from Condition 6 (106.3% and 109.2% RBS) are surprisingly not the highest of all, even though this condition represents the combination of best conditions for both inner-core lay angle and outer-core lay length.

Figure 10:
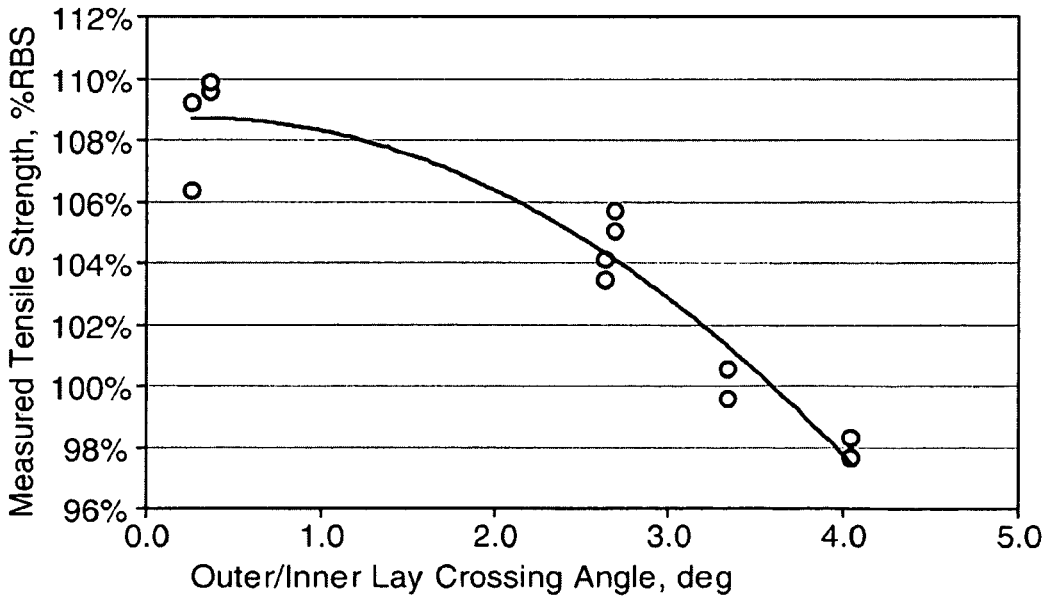
FIG. 10 is a plot of the effect of the crossing angle on measured tensile strength for exemplary helically stranded composite cables of the present disclosure.

These surprising aspects may be explained by plotting all experimental results as a function of the crossing angle. FIG. 10 shows a plot of the relative difference between lay angles of the inner and outer layers (Outer/Inner Lay Crossing Angle) on measured tensile strength for exemplary helically stranded composite cables of the present disclosure. This trend is statistically highly significant, and is described by a quadratic fit with an adjusted coefficient of determination ($R^2$) of 0.904.

As demonstrated by these results, the tensile strength of an ACCR composite cable with a 19-wire core can be substantially increased by altering the core construction so as to minimize the crossing angle between inner and outer core wires. Overall longer core lay lengths provide some benefit, primarily due to the associated crossing-angle decrease. However, as taught by this disclosure, the simplest and most effective method of obtaining increased tensile strength is to reverse the lay orientation of alternate core layers so that all core layers have the same orientation.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g. 1 to 5 includes 1, 1.5, 2, 2.75, 3, 3.80, 4, and 5). In addition, all numbers used herein are assumed to be modified by the term 'about'.

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

The invention claimed is:

1. A stranded cable, comprising:

a single wire comprising a single filament defining a center longitudinal axis;

a first plurality of single filament composite wires stranded around the single wire in a first lay direction at a first lay angle defined relative to the center longitudinal axis and having a first lay length; and a second plurality of single filament composite wires stranded around the first plurality of composite wires in the first lay direction at a second lay angle defined relative to the center longitudinal axis and having a second lay length, wherein a relative difference between the first lay angle and the second lay angle is no greater than about 4°.

2. The stranded cable of claim 1, wherein the single wire has a cross-section taken in a direction substantially normal to the center longitudinal axis, and wherein a cross-sectional shape of the single wire is circular or elliptical.

3. The stranded cable of claim 2, wherein the single wire is a composite wire.

4. The stranded cable of claim 3, wherein each of the composite wires is substantially continuous and at least 150 m long.

5. The stranded cable of claim 1, wherein each composite wire has a cross-section in a direction substantially normal to the center longitudinal axis, and wherein a cross-sectional shape of each composite wire is selected from the group consisting of circular, elliptical, and trapezoidal.

6. The stranded cable of claim 5, wherein each of the composite wires has cross-sectional shape that is circular, and wherein the diameter each composite wire is from about 1 mm to about 4 mm.

7. The stranded cable of claim 1, wherein each of the first plurality of composite wires and the second plurality of composite wires is helically stranded to have a lay factor of from 10 to 150.

8. The stranded cable of claim 1, further comprising a third plurality of composite wires stranded around second plurality of composite wires in the first lay direction at a third lay angle defined relative to the center longitudinal axis and having a third lay length, wherein a relative difference between the second lay angle and the third lay angle is no greater than about 4°.

9. The stranded cable of claim 8, further comprising a fourth plurality of composite wires stranded around the third plurality of composite wires in the first lay direction at a fourth lay angle defined relative to the center longitudinal axis and having a fourth lay length, wherein a relative difference between the third lay angle and the fourth lay angle is no greater than about 4°.

10. The stranded cable of claim 1, wherein each of the composite wires is a fiber reinforced composite wire.

11. The stranded cable of claim 10, wherein at least one of the fiber reinforced composite wires is reinforced with one of a fiber tow or a monofilament fiber.

12. The stranded cable of claim 11, wherein each of the composite wires is selected from the group consisting of a metal matrix composite wire and a polymer composite wire.

13. The stranded cable of claim 12, wherein the polymer composite wire comprises at least one continuous fiber in a polymer matrix.

14. The stranded cable of claim 13, wherein the at least one continuous fiber comprises metal, carbon, ceramic, glass, or combinations thereof

15. The stranded cable of claim 13, wherein the at least one continuous fiber comprises titanium, tungsten, boron, shape memory alloy, carbon, carbon nanotubes, graphite, silicon carbide, aramid, poly(p-phenylene-2,6-benzobisoxazole, or combinations thereof

16. The stranded cable of claim 13, wherein the polymer matrix comprises a (co)polymer selected from the group consisting of an epoxy, an ester, a vinyl ester, a polyimide, a polyester, a cyanate ester, a phenolic resin, a bis-maleimide resin, polyetheretherketone, and combinations thereof.

17. The stranded cable of claim 12, wherein the metal matrix composite comprises at least one continuous fiber in a metal matrix.

18. The stranded cable of claim 17, wherein the at least one continuous fiber comprises a material selected from the group consisting of ceramics, glasses, carbon nanotubes, carbon, silicon carbide, boron, iron, steel, ferrous alloys, tungsten, titanium, shape memory alloy, and combinations thereof

19. The stranded cable of claim 17, wherein the metal matrix comprises aluminum, zinc, tin, magnesium, alloys thereof, or combinations thereof.

20. The stranded cable of claim 19, wherein the metal matrix comprises aluminum, and the at least one continuous fiber comprises a ceramic fiber.

21. The stranded cable of claim 20, wherein the ceramic fiber comprises polycrystalline $\alpha$-$Al_2O_3$.

22. The stranded cable of claim 1, further comprising a plurality of ductile wires stranded around the composite wires.

23. The stranded cable of claim 22, wherein at least a portion of the plurality of ductile wires is stranded in the first lay direction.

24. The stranded cable of claim 22, wherein at least a portion of the plurality of ductile wires is stranded in a second lay direction opposite to the first lay direction.

25. The stranded cable of claim 22, wherein the plurality of ductile wires is stranded about the center longitudinal axis in a plurality of radial layers surrounding the composite wires.

26. The stranded cable of claim 25, wherein each radial layer is stranded in a lay direction opposite to that of an adjoining radial layer.

27. The stranded cable of claim 22, wherein each ductile wire has a cross-section in a direction substantially normal to the center longitudinal axis, and wherein a cross-sectional shape of each ductile wire is selected from the group consisting of circular, elliptical, trapezoidal, S-shaped, and Z-shaped.

28. The stranded cable of claim 22, wherein the ductile wires comprise at least one metal selected from the group consisting of iron, steel, zirconium, copper, tin, cadmium, aluminum, manganese, zinc, cobalt, nickel, chromium, titanium, tungsten, vanadium, their alloys with each other, their alloys with other metals, their alloys with silicon, and combinations thereof

29. The stranded cable of claim 1, wherein the relative difference between the first lay angle and the second lay angle is no greater than 3°.

30. The stranded cable of claim 1, wherein the relative difference between the first lay angle and the second lay angle is no greater than 0.5°.

31. The stranded cable of claim 1, wherein the first lay length equals the second lay length.

32. The stranded cable of claim 1, wherein the first lay angle equals the second lay angle.

33. The stranded cable of claim 1, further comprising a maintaining means around at least one of the first plurality of composite wires and the second plurality of composite wires.

34. The stranded cable of claim 33, wherein the maintaining means comprises at least one of a binder, a non-adhesive tape, or an adhesive tape.

35. The stranded cable of claim 34, wherein the adhesive tape comprises a pressure sensitive adhesive.

36. An electrical power transmission cable comprising a core and a conductor layer around the core, wherein the core comprises the stranded cable of claim 1.

37. The electrical power transmission cable of claim 36, wherein the conductor layer comprises a plurality of stranded conductor wires.

38. The electrical power transmission cable of claim 36, wherein the electrical power transmission cable is selected from the group consisting of an overhead electrical power transmission cable, and an underground electrical power transmission cable.

39. A method of making the stranded cable of claim 1, comprising:

stranding a first plurality of single filament composite wires about a single wire comprising a single filament defining a center longitudinal axis, wherein stranding the first plurality of composite wires is carried out in a first lay direction at a first lay angle defined relative to the center longitudinal axis, and wherein the first plurality of composite wires has a first lay length; and stranding a second plurality of single filament composite wires around the first plurality of composite wires, wherein stranding the second plurality of composite wires is carried out in the first lay direction at a second lay angle defined relative to the center longitudinal axis, and wherein the second plurality of composite wires has a second lay length, further wherein a relative difference between the first lay angle and the second lay angle is no greater than 4°.

40. The method of claim 39, further comprising stranding a plurality of ductile wires around the composite wires.

* * * * *